US008740687B1

(12) United States Patent
Brown et al.

(10) Patent No.: US 8,740,687 B1
(45) Date of Patent: Jun. 3, 2014

(54) GAMING SYSTEM AND METHOD PROVIDING A KENO GAME PROVIDING AN ADDITIONAL AWARD IF A PREDICTED QUANTITY OF SYMBOLS MATCHES AN ACTUAL QUANTITY OF SYMBOLS ASSOCIATED WITH ONE OF A PLURALITY OF DIFFERENT CHARACTERISTICS

(71) Applicant: IGT, Reno, NV (US)

(72) Inventors: Bradford D. Brown, Sparks, NV (US); Benjamin R. Holsclaw, Sparks, NV (US); Robert W. Ruymann, Reno, NV (US); Thomas J. Humphrey, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/788,324

(22) Filed: Mar. 7, 2013

(51) Int. Cl.
*G07F 17/32* (2006.01)

(52) U.S. Cl.
CPC ..... *G07F 17/3262* (2013.01); *G07F 17/32* (2013.01)
USPC ..... 463/18; 463/16; 463/20

(58) Field of Classification Search
CPC ... G07F 17/32; G07F 17/326; G07F 17/3262; G07F 17/3288; G07F 17/329; G07F 17/34
USPC ..... 463/16–20
See application file for complete search history.

(56) References Cited

U.S. PATENT DOCUMENTS 3,825,255 A 7/1974 Kennard
4,033,588 A 7/1977 Watts et al.
4,508,353 A 4/1985 Meyer et al.
4,582,324 A 4/1986 Koza et al.
4,611,811 A 9/1986 Haase et al.
4,624,459 A 11/1986 Kaufman et al.
4,661,906 A 4/1987 Difrancesco et al.
4,695,053 A 9/1987 Vazquez et al.
4,711,454 A 12/1987 Small
4,747,600 A 5/1988 Richardson et al.
4,775,155 A 10/1988 Lees
4,798,387 A 1/1989 Richardson
4,875,686 A 10/1989 Timms
5,005,840 A 4/1991 Schwartz et al.

(Continued)

FOREIGN PATENT DOCUMENTS

EP 1 513 116 3/2005
WO WO 2004/014502 2/2004

(Continued)

*Primary Examiner* — Sunit Pandya
*Assistant Examiner* — Jasson Yoo
(74) *Attorney, Agent, or Firm* — Neal, Gerber & Eisenberg LLP

(57) ABSTRACT

Various embodiments of the present disclosure are directed to a gaming system and method providing a Keno game providing an additional award if a predicted quantity of symbols matches an actual quantity of symbols associated with one of a plurality of characteristics. In one embodiment, for one of a plurality of characteristics, the gaming system receives an indication of a predicted quantity of symbols. The gaming system forms a gaming system symbol set including a plurality of randomly selected symbols, each of which is randomly associated with one of the characteristics. The gaming system determines any primary awards by comparing a player symbol set with the gaming system symbol set, and any additional awards by comparing the predicted quantity of symbols with the randomly determined actual quantity of symbols associated with the characteristic associated with the predicted quantity of symbols.

20 Claims, 11 Drawing Sheets

(56) References Cited

U.S. PATENT DOCUMENTS

| | | | |
|---|---|---|---|
| 5,035,422 | A | 7/1991 | Berman et al. |
| 5,035,625 | A | 7/1991 | Munson et al. |
| 5,043,887 | A | 8/1991 | Richardson et al. |
| 5,046,737 | A | 9/1991 | Fienberg |
| 5,072,381 | A | 12/1991 | Richardson et al. |
| 5,072,946 | A | 12/1991 | Miller et al. |
| 5,106,089 | A | 4/1992 | Wood |
| 5,116,049 | A | 5/1992 | Sludikoff |
| 5,154,420 | A | 10/1992 | Gutknecht et al. |
| 5,158,293 | A | 10/1992 | Mullins |
| 5,205,555 | A | 4/1993 | Hamano |
| 5,242,163 | A | 9/1993 | Fulton et al. |
| 5,324,041 | A | 6/1994 | Boylan et al. |
| 5,342,047 | A | 8/1994 | Heidel |
| 5,351,970 | A | 10/1994 | Fioretti et al. |
| 5,393,057 | A | 2/1995 | Marnell et al. |
| 5,401,024 | A | 3/1995 | Simunek |
| 5,407,200 | A | 4/1995 | Zalabak et al. |
| 5,411,271 | A | 5/1995 | Mirando |
| 5,419,592 | A | 5/1995 | Stuart et al. |
| 5,423,539 | A | 6/1995 | Nagao |
| 5,449,173 | A | 9/1995 | Thomas et al. |
| 5,482,289 | A | 1/1996 | Weingardt et al. |
| 5,501,455 | A | 3/1996 | Hirata et al. |
| 5,524,888 | A | 6/1996 | Heidel |
| 5,536,016 | A | 7/1996 | Thompson |
| 5,542,669 | A | 8/1996 | Charron et al. |
| 5,560,603 | A | 10/1996 | Seelig et al. |
| 5,569,083 | A | 10/1996 | Fioretti et al. |
| 5,586,937 | A | 12/1996 | Menashe |
| 5,611,535 | A | 3/1997 | Tiberio |
| 5,611,729 | A | 3/1997 | Schumacher et al. |
| 5,611,730 | A | 3/1997 | Weiss et al. |
| 5,628,684 | A | 5/1997 | Bouedec et al. |
| 5,639,089 | A | 6/1997 | Matsumoto et al. |
| 5,645,486 | A | 7/1997 | Nagao et al. |
| 5,647,798 | A | 7/1997 | Falciglia |
| 5,651,735 | A | 7/1997 | Baba |
| 5,679,077 | A | 10/1997 | Pocock et al. |
| 5,687,971 | A | 11/1997 | Khaladkar |
| 5,718,631 | A | 2/1998 | Invencion et al. |
| 5,722,891 | A | 3/1998 | Inoue |
| 5,727,786 | A | 3/1998 | Weingardt et al. |
| 5,732,948 | A | 3/1998 | Yoseloff et al. |
| 5,743,526 | A | 4/1998 | Inoue |
| 5,755,619 | A | 5/1998 | Matsumoto et al. |
| 5,769,716 | A | 6/1998 | Saffari et al. |
| 5,772,509 | A | 6/1998 | Weiss et al. |
| 5,779,545 | A | 7/1998 | Berg et al. |
| 5,788,573 | A | 8/1998 | Baerlocher et al. |
| 5,800,269 | A | 9/1998 | Holch et al. |
| 5,813,911 | A | 9/1998 | Margolin |
| 5,823,534 | A | 10/1998 | Banyai et al. |
| 5,823,874 | A | 10/1998 | Adams et al. |
| 5,833,537 | A | 11/1998 | Barrie |
| 5,848,932 | A | 12/1998 | Adams et al. |
| 5,851,148 | A | 12/1998 | Brune et al. |
| 5,855,514 | A | 1/1999 | Kamille et al. |
| 5,857,911 | A | 1/1999 | Fioretti et al. |
| 5,871,398 | A | 2/1999 | Schneier et al. |
| 5,882,261 | A | 3/1999 | Adams et al. |
| 5,909,875 | A | 6/1999 | Weingardt et al. |
| 5,910,046 | A | 6/1999 | Wada et al. |
| 5,911,418 | A | 6/1999 | Adams et al. |
| 5,919,088 | A | 7/1999 | Weiss et al. |
| 5,927,714 | A | 7/1999 | Kaplan |
| 5,928,081 | A | 7/1999 | Bochichio et al. |
| 5,935,001 | A | 8/1999 | Baba et al. |
| 5,935,002 | A | 8/1999 | Falciglia |
| 5,944,314 | A | 8/1999 | Stavinsky et al. |
| 5,945,655 | A | 8/1999 | Gilgeous et al. |
| 5,947,820 | A | 9/1999 | Morro et al. |
| 5,951,397 | A | 9/1999 | Dickinson |
| 5,954,336 | A | 9/1999 | Goossens et al. |
| 5,971,849 | A | 10/1999 | Falciglia et al. |
| 5,980,384 | A | 11/1999 | Barrie |
| 5,984,781 | A | 11/1999 | Sunaga |
| 5,988,643 | A | 11/1999 | Awada et al. |
| 5,989,121 | A | 11/1999 | Sakamoto |
| 5,996,997 | A | 12/1999 | Kamille et al. |
| 5,997,400 | A | 12/1999 | Seelig et al. |
| 5,997,401 | A | 12/1999 | Crawford |
| 6,004,207 | A | 12/1999 | Wilson et al. |
| 6,015,346 | A | 1/2000 | Bennett |
| 6,017,032 | A | 1/2000 | Grippo et al. |
| 6,019,369 | A | 2/2000 | Nakagawa et al. |
| 6,024,640 | A | 2/2000 | Walker et al. |
| 6,033,306 | A | 3/2000 | De Souza et al. |
| 6,033,307 | A | 3/2000 | Vancura et al. |
| 6,056,642 | A | 5/2000 | Bennett |
| 6,059,289 | A | 5/2000 | Vancura et al. |
| 6,059,658 | A | 5/2000 | Mangano et al. |
| 6,071,192 | A | 6/2000 | Weiss |
| 6,079,711 | A | 6/2000 | Wei et al. |
| 6,089,976 | A | 7/2000 | Schneider et al. |
| 6,089,977 | A | 7/2000 | Bennett |
| 6,089,978 | A | 7/2000 | Adams et al. |
| 6,093,102 | A | 7/2000 | Bennett et al. |
| 6,099,407 | A | 8/2000 | Parker et al. |
| 6,102,400 | A | 8/2000 | Scott et al. |
| 6,102,798 | A | 8/2000 | Bennett |
| 6,120,376 | A | 9/2000 | Cherry et al. |
| 6,120,377 | A | 9/2000 | McGinnis et al. |
| 6,126,542 | A | 10/2000 | Fier |
| 6,129,355 | A | 10/2000 | Hahn et al. |
| 6,135,882 | A | 10/2000 | Kadlic et al. |
| 6,135,884 | A | 10/2000 | Hedrick et al. |
| 6,142,873 | A | 11/2000 | Weiss et al. |
| 6,142,874 | A | 11/2000 | Kodachi et al. |
| 6,142,875 | A | 11/2000 | Kodachi et al. |
| 6,146,271 | A | 11/2000 | Kadlic et al. |
| 6,146,272 | A | 11/2000 | Walker et al. |
| 6,159,095 | A | 12/2000 | Frohm et al. |
| 6,159,096 | A | 12/2000 | Yoseloff |
| 6,159,097 | A | 12/2000 | Gura et al. |
| 6,159,098 | A | 12/2000 | Slomiany et al. |
| 6,162,121 | A | 12/2000 | Morro et al. |
| 6,164,652 | A | 12/2000 | Lauretta et al. |
| 6,168,520 | B1 | 1/2001 | Baerlocher et al. |
| 6,168,521 | B1 | 1/2001 | Luciano et al. |
| 6,168,523 | B1 | 1/2001 | Piechowiak et al. |
| 6,173,955 | B1 | 1/2001 | Perrie et al. |
| 6,174,234 | B1 | 1/2001 | Seibert, Jr. et al. |
| 6,174,235 | B1 | 1/2001 | Walker et al. |
| 6,179,711 | B1 | 1/2001 | Yoseloff |
| 6,183,361 | B1 | 2/2001 | Cummings et al. |
| 6,186,892 | B1 | 2/2001 | Frank |
| 6,186,894 | B1 | 2/2001 | Mayeroff |
| 6,190,255 | B1 | 2/2001 | Thomas et al. |
| 6,210,276 | B1 | 4/2001 | Mullins |
| 6,210,279 | B1 | 4/2001 | Dickinson |
| 6,220,961 | B1 | 4/2001 | Keane et al. |
| 6,224,483 | B1 | 5/2001 | Mayeroff |
| 6,227,969 | B1 | 5/2001 | Yoseloff |
| 6,227,971 | B1 | 5/2001 | Weiss |
| 6,231,442 | B1 | 5/2001 | Mayeroff |
| 6,234,897 | B1 | 5/2001 | Frohm et al. |
| 6,238,288 | B1 | 5/2001 | Walker et al. |
| 6,241,606 | B1 | 6/2001 | Riendeau et al. |
| 6,250,685 | B1 | 6/2001 | Walker et al. |
| 6,257,980 | B1 | 7/2001 | Santini, Jr. |
| 6,270,407 | B1 | 8/2001 | Dodge |
| 6,280,325 | B1 | 8/2001 | Fisk |
| 6,283,855 | B1 | 9/2001 | Bingham |
| 6,296,568 | B1 | 10/2001 | Tracy |
| 6,299,165 | B1 | 10/2001 | Nagano |
| 6,305,686 | B1 | 10/2001 | Perrie et al. |
| 6,309,298 | B1 | 10/2001 | Gerow |
| 6,309,300 | B1 | 10/2001 | Glavich |
| 6,312,334 | B1 | 11/2001 | Yoseloff |
| 6,315,290 | B1 | 11/2001 | Roethel et al. |
| 6,315,291 | B1 | 11/2001 | Moody |
| 6,315,660 | B1 | 11/2001 | DeMar et al. |
| 6,315,663 | B1 | 11/2001 | Sakamoto |

(56) References Cited

U.S. PATENT DOCUMENTS 6,315,664 B1 11/2001 Baerlocher et al.
6,322,309 B1 11/2001 Thomas et al.
6,325,716 B1 12/2001 Walker et al.
6,328,649 B1 12/2001 Randall et al.
6,331,143 B1 * 12/2001 Yoseloff ..... 463/18
6,334,814 B1 1/2002 Adams
6,336,860 B1 1/2002 Webb
6,336,862 B1 1/2002 Byrne
6,346,043 B1 2/2002 Colin et al.
6,358,151 B1 3/2002 Enzminger et al.
6,364,313 B1 4/2002 Moody
6,364,767 B1 4/2002 Brossard et al.
6,368,212 B1 4/2002 Moody
6,368,213 B1 4/2002 McNabola
6,368,214 B1 4/2002 Luciano
6,368,218 B2 4/2002 Angell, Jr.
6,398,644 B1 6/2002 Perrie et al.
6,398,645 B1 6/2002 Yoseloff
6,398,646 B1 6/2002 Wei et al.
6,402,614 B1 6/2002 Schneier et al.
6,406,369 B1 6/2002 Baerlocher et al.
6,413,160 B1 7/2002 Vancura
6,416,408 B2 7/2002 Tracy et al.
6,419,579 B1 7/2002 Bennett
6,419,583 B1 7/2002 Crumby et al.
6,425,823 B1 7/2002 Byrne
6,425,824 B1 7/2002 Baerlocher et al.
6,439,995 B1 8/2002 Hughs-Baird et al.
6,471,208 B2 10/2002 Yoseloff et al.
6,478,677 B1 11/2002 Moody
6,481,713 B2 11/2002 Perrie et al.
6,482,088 B2 11/2002 Santini, Jr.
6,506,118 B1 1/2003 Baerlocher et al.
6,514,141 B1 2/2003 Kaminkow et al.
6,514,144 B2 2/2003 Riendeau et al.
6,524,184 B1 2/2003 Lind et al.
6,533,660 B2 3/2003 Seelig et al.
6,547,242 B1 4/2003 Sugiyama et al.
6,565,084 B1 5/2003 Katz et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,602,135 B1 8/2003 Gerrard
6,605,001 B1 8/2003 Tarantino
6,607,438 B2 8/2003 Baerlocher et al.
6,607,440 B2 8/2003 Santini, Jr.
6,609,973 B1 8/2003 Weiss
6,638,164 B2 10/2003 Randall et al.
6,645,071 B2 11/2003 Perrie et al.
6,645,072 B1 11/2003 Kellen
6,656,044 B1 12/2003 Lewis
6,656,045 B2 12/2003 Wei et al.
6,672,960 B1 1/2004 B-Jensen
6,676,516 B2 1/2004 Baerlocher et al.
6,692,354 B2 2/2004 Tracy et al.
6,702,669 B2 3/2004 Moody
6,719,630 B1 4/2004 Seelig et al.
6,722,655 B1 4/2004 Camero
6,722,981 B2 4/2004 Kaminkow et al.
6,722,982 B2 4/2004 Kaminkow et al.
6,746,328 B2 6/2004 Cannon et al.
6,755,738 B2 6/2004 Glasson et al.
6,755,739 B2 6/2004 Santini, Jr.
6,764,397 B1 7/2004 Robb
6,780,108 B1 8/2004 Luciano, Jr. et al.
6,783,457 B2 8/2004 Hughs-Baird et al.
6,802,776 B2 10/2004 Lind et al.
6,817,943 B2 11/2004 Gerrard
6,824,465 B2 * 11/2004 Luciano, Jr. ..... 463/18
6,832,956 B1 12/2004 Boyd et al.
6,835,138 B2 12/2004 Baeg
6,840,858 B2 1/2005 Adams
6,910,962 B2 6/2005 Marks et al.
6,971,954 B2 12/2005 Randall
6,981,635 B1 1/2006 Hughs-Baird et al.
6,988,948 B2 * 1/2006 Perrie et al. ..... 463/25
7,160,186 B2 1/2007 Cuddy et al.
7,160,188 B2 1/2007 Kaminkow et al.
7,169,047 B2 * 1/2007 Benbrahim ..... 463/25
7,182,689 B2 2/2007 Hughs-Baird et al.
7,235,011 B2 6/2007 Randall et al.
7,258,608 B2 8/2007 Khal
7,273,415 B2 9/2007 Cregan et al.
7,281,979 B2 * 10/2007 Luciano, Jr. ..... 463/18
7,303,469 B2 12/2007 Kaminkow
7,306,519 B2 12/2007 Baerlocher
7,314,408 B2 * 1/2008 Cannon ..... 463/16
7,314,409 B2 1/2008 Maya et al.
7,338,371 B2 3/2008 Cheng et al.
7,341,513 B2 3/2008 Cuddy et al.
7,399,227 B2 7/2008 Michaelson et al.
7,481,706 B2 1/2009 Dodge
7,588,494 B2 9/2009 Hughs-Baird et al.
7,614,953 B2 * 11/2009 Souza et al. ..... 463/20
7,682,241 B2 3/2010 Baerlocher
7,749,065 B1 * 7/2010 Englman ..... 463/17
7,963,847 B2 * 6/2011 Baerlocher ..... 463/27
8,025,561 B2 9/2011 Reddicks et al.
8,047,909 B2 * 11/2011 Walker et al. ..... 463/16
8,070,587 B2 * 12/2011 Davis et al. ..... 463/20
8,113,939 B2 * 2/2012 Cannon ..... 463/18
2002/0025847 A1 2/2002 Thomas et al.
2002/0034974 A1 3/2002 Wood et al.
2002/0045472 A1 4/2002 Adams
2002/0052231 A1 5/2002 Fioretti
2002/0063387 A1 5/2002 Timpano
2002/0094859 A1 7/2002 Hirsch et al.
2002/0098882 A1 7/2002 Lind et al.
2002/0098883 A1 7/2002 Packes, Jr. et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0169018 A1 11/2002 Schneier et al.
2002/0177478 A1 11/2002 Glasson et al.
2002/0187827 A1 12/2002 Blankstein
2003/0017867 A1 1/2003 deKeller
2003/0104852 A1 6/2003 Duhamel
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia, Sr.
2003/0193136 A1 10/2003 Walker et al.
2003/0195032 A1 10/2003 Enzminger et al.
2003/0216168 A1 11/2003 Cannon et al.
2004/0009806 A1 1/2004 Odom
2004/0048647 A1 3/2004 Lind et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.
2004/0178579 A1 9/2004 Lowell et al.
2004/0204224 A1 * 10/2004 Finnochio ..... 463/18
2004/0204225 A1 10/2004 Campo et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0059449 A1 3/2005 Yarbrough
2005/0059461 A1 3/2005 Ching et al.
2005/0059467 A1 3/2005 Saffari et al.
2005/0059468 A1 3/2005 Cannon
2005/0059469 A1 3/2005 Gail et al.
2005/0059470 A1 3/2005 Cannon
2005/0059471 A1 3/2005 Cannon
2005/0064932 A1 3/2005 Cannon

(56) References Cited

U.S. PATENT DOCUMENTS

| | | | |
|---|---|---|---|
| 2005/0075161 | A1 | 4/2005 | McGlone et al. |
| 2005/0096119 | A1 | 5/2005 | Lind et al. |
| 2005/0096123 | A1 | 5/2005 | Cregan et al. |
| 2005/0101370 | A1 | 5/2005 | Lind et al. |
| 2005/0101387 | A1 | 5/2005 | Wolf |
| 2005/0119042 | A1 | 6/2005 | Chamberlain et al. |
| 2005/0130730 | A1 | 6/2005 | Lind et al. |
| 2005/0148382 | A1 | 7/2005 | Fox |
| 2005/0164771 | A1 | 7/2005 | Lind et al. |
| 2005/0164772 | A1 | 7/2005 | Lind et al. |
| 2005/0164773 | A1 | 7/2005 | Lind et al. |
| 2005/0167916 | A1 | 8/2005 | Banyai |
| 2005/0187014 | A1 | 8/2005 | Saffari et al. |
| 2005/0192081 | A1 | 9/2005 | Marks et al. |
| 2005/0227753 | A1 | 10/2005 | Luciano |
| 2005/0255906 | A1 | 11/2005 | Lind et al. |
| 2006/0084490 | A1 | 4/2006 | Khal |
| 2006/0189375 | A1 | 8/2006 | Dodge |
| 2006/0246977 | A1 | 11/2006 | Cannon |
| 2007/0021185 | A1 | 1/2007 | Walker et al. |
| 2007/0052172 | A1 | 3/2007 | Dargue |
| 2007/0117611 | A1 | 5/2007 | Dodge |
| 2007/0207848 | A1 | 9/2007 | Roethel |
| 2008/0102952 | A1 | 5/2008 | Walker et al. |
| 2008/0254894 | A1 | 10/2008 | Michaelson et al. |
| 2009/0197664 | A1 | 8/2009 | Schultz |
| 2010/0120489 | A1 | 5/2010 | Meyer |
| 2011/0028201 | A1 | 2/2011 | Warner et al. |
| 2012/0129588 | A1* | 5/2012 | Cannon ..... 463/20 |

FOREIGN PATENT DOCUMENTS

| | | |
|---|---|---|
| WO | WO 2004/070551 | 8/2004 |
| WO | WO 2004/105903 | 12/2004 |
| WO | WO 2005/060567 | 7/2005 |
| WO | WO 2005/072096 | 8/2005 |
| WO | WO 2005/079142 | 9/2005 |

* cited by examiner

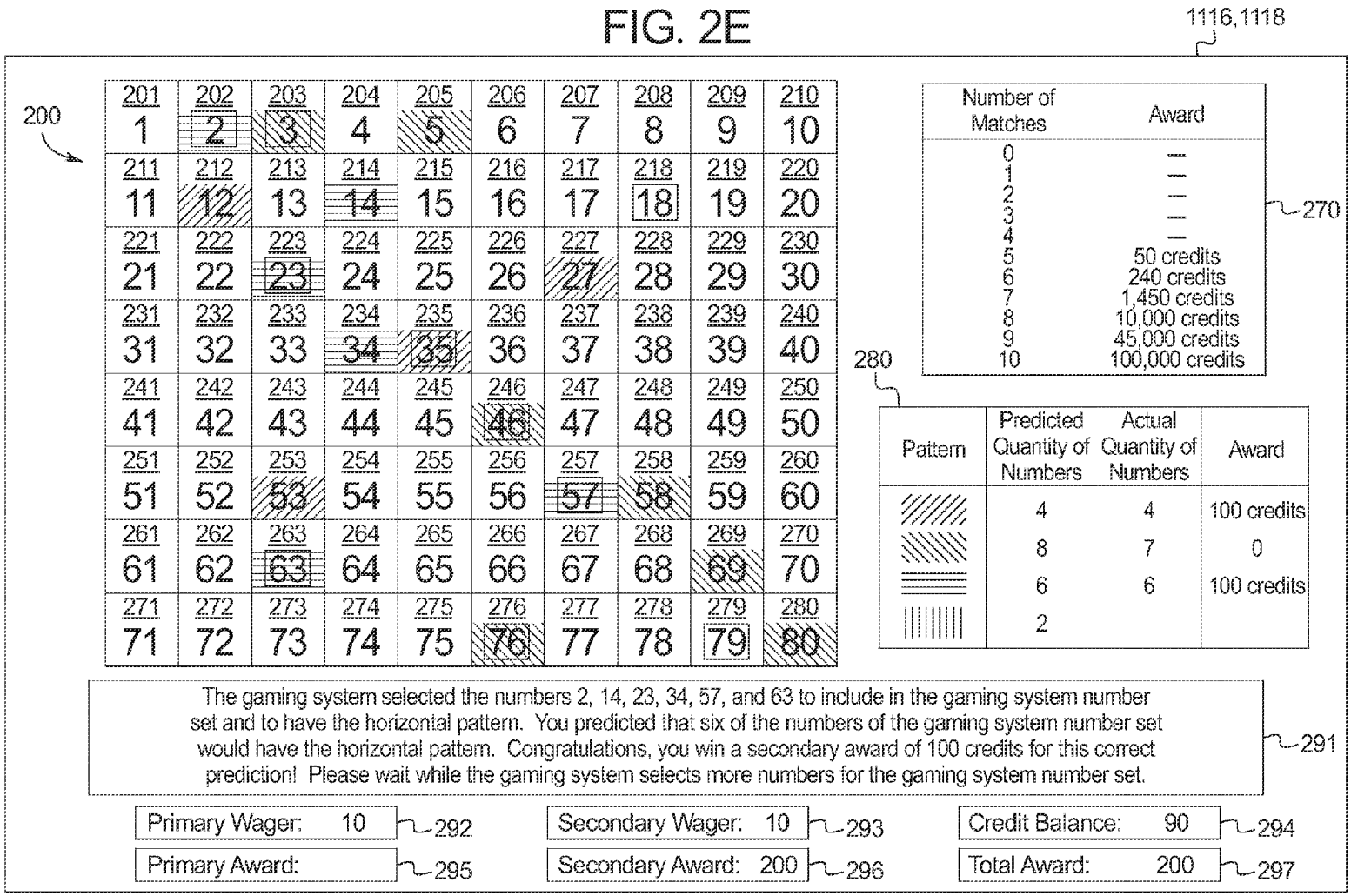
FIG. 2E
1116, 1118
200
201 202 203 204 205 206 207 208 209 210
1 2 3 4 5 6 7 8 9 10
211 212 213 214 215 216 217 218 219 220
11 12 13 14 15 16 17 18 19 20
221 222 223 224 225 226 227 228 229 230
21 22 23 24 25 26 27 28 29 30
231 232 233 234 235 236 237 238 239 240
31 32 33 34 35 36 37 38 39 40
241 242 243 244 245 246 247 248 249 250
41 42 43 44 45 46 47 48 49 50
251 252 253 254 255 256 257 258 259 260
51 52 53 54 55 56 57 58 59 60
261 262 263 264 265 266 267 268 269 270
61 62 63 64 65 66 67 68 69 70
271 272 273 274 275 276 277 278 279 280
71 72 73 74 75 76 77 78 79 80
270
Number of Matches
Award
0 —
1 —
2 —
3 —
4 —
5 50 credits
6 240 credits
7 1,450 credits
8 10,000 credits
9 45,000 credits
10 100,000 credits
280
Pattern
Predicted Quantity of Numbers
Actual Quantity of Numbers
Award
4 4 100 credits
8 7 0
6 6 100 credits
2
291
The gaming system selected the numbers 2, 14, 23, 34, 57, and 63 to include in the gaming system number set and to have the horizontal pattern. You predicted that six of the numbers of the gaming system number set would have the horizontal pattern. Congratulations, you win a secondary award of 100 credits for this correct prediction! Please wait while the gaming system selects more numbers for the gaming system number set.
Primary Wager: 10
292
Secondary Wager: 10
293
Credit Balance: 90
294
Primary Award:
295
Secondary Award: 200
296
Total Award: 200
297

GAMING SYSTEM AND METHOD PROVIDING A KENO GAME PROVIDING AN ADDITIONAL AWARD IF A PREDICTED QUANTITY OF SYMBOLS MATCHES AN ACTUAL QUANTITY OF SYMBOLS ASSOCIATED WITH ONE OF A PLURALITY OF DIFFERENT CHARACTERISTICS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Keno in the United States traces back to a "Chinese lottery" game brought to the United States by Chinese immigrants in the 1800s. The "Chinese lottery" game utilized a board and a set of up to 120 characters instead of numbers. Early versions of American Keno used characters on Keno tickets rather than the numbers used today. The American Keno game reduced the number of characters to the more familiar eighty.

When gambling was legalized in the state of Nevada in 1931, the "Chinese lottery" game was instead referred to as Horse Race Keno, reflecting the idea that the numbers are horses and the players want their wagered-on horses to come in. Later, the name was shortened to simply Keno, although the game is still often referred to as Horse Race Keno.

Keno is similar to a lottery game. The goal in Keno, like in a lottery, is for a player to choose winning numbers from a plurality of numbers. In most standard versions of paper or video based Keno, a player receives a card with eighty squares numbered one to eighty and arranged in eight rows of ten. The player can wager on any number or numbers up to a designated quantity of numbers, such as ten numbers. The player chooses numbers on which the player desires to wager by marking those numbers on a Keno card (such as in a paper version of Keno) or by selecting the numbers on a keno display (such as in a video version of Keno). A clerk or the processor of the video display records the player's wager(s). The player pays for each number played or wagered on.

In one known paper version, the Keno numbers also appear on eighty ping pong type balls that can be tossed about in a clear plastic sphere or spun around in a wire bird cage. Keno numbers were at one time drawn from such apparatuses without replacement using a manually powered Keno goose. In one known video version, a computer generates the Keno numbers without replacement using a random number generator. After a number is chosen, that number is shown electronically on Keno boards throughout the casino or on the video display. An award is provided to the player based on a quantity of matches between the player selected number(s) and the game generated number(s).

Many casinos offer "multi-race" cards that enable the player to play the same set of numbers over multiple games. One type of "multi-play" game enables the player to wager on a single set of numbers over as many as twenty games. When finished, the player must return to the Keno station and cash in any wins. "Stray and play" tickets are also available, and enable the player to play a version of Keno called "walk away Keno." Here, players can purchase a Keno ticket for an extended number of games, enjoy other activities in the casino, and return at a later time or even a later date to have the tickets checked by a computer for winning games.

Another option for Keno players is a combination or "way" ticket. A combination ticket enables the player to group different numbers, wherein each group has the same amount numbers, creating more than one way to win. For example, a 3×3×3, nine spot ticket enables the player to select a combination of three groups of three numbers. The player can, for example, mark a first group of three numbers with the letter "A," mark a second group with the letter "B," and mark a third group the letter "C." This ticket enables the player to win on any winning combination of three numbers for any of the three groups. Hitting any winning combination pays as though a single ticket had been played. Essentially, the player plays three games on one card. In some Keno games, playing three numbers in three games enables the player to play, or provides to the player, an additional nine spot game.

The "way" ticket supposedly makes Keno more exciting, enabling players to wager more money on more numbers. In reality, playing a way or combination ticket offers no mathematical advantage, and no disadvantage, to the player. Some casinos offer discounted minimum wagers with "way" tickets. If the player plays three or more ways, many casinos will discount the price per "way" (e.g., let the player wager $0.50 per wager instead of a usual $1 minimum). However, the casino only pays back on the player's actual wager.

Certain variations of Keno have expected returns that are relatively constant regardless of how many numbers the player plays. That is, it does not mathematically matter how many numbers the player chooses or if the player combines wagers. The player can choose fewer numbers if the player likes to win a smaller amount but a little more often. The player can choose more numbers if the player does not care about the frequency of the wins but wants bigger payouts. In other versions, the expected value fluctuates based on how many numbers the player plays.

Keno is a popular game that has been embodied in various types of gaming systems. A need exists to provide variations of Keno to make the play of Keno more enjoyable, fun, and exciting for players.

SUMMARY

Various embodiments of the present disclosure are directed to a gaming system and method providing a Keno game providing an additional award if a predicted quantity of symbols matches an actual quantity of symbols associated with one of a plurality of different characteristics.

In operation of one embodiment, the gaming system displays a plurality of different symbols (such as the numbers 1 through 80). The gaming system receives, from a player, an indication of a plurality of the symbols forming a player symbol set. For one of a plurality of different characteristics, the gaming system receives an indication of a predicted quantity of symbols from the player. More specifically, the gaming system receives an indication from the player of how many of the symbols of a gaming system symbol set the player predicts will be associated with that characteristic. The gaming system randomly determines an actual quantity of symbols for each of the characteristics. That is, the gaming system determines, for each of the characteristics, how many of the symbols of the gaming system symbol set will be associated with that characteristic.

For each of the characteristics, the gaming system randomly selects a number of the symbols equal to the randomly determined actual quantity of symbols associated with that characteristic, associates each of those randomly selected symbols with that characteristic, and adds each of those randomly selected symbols to the gaming system symbol set. The gaming system determines any primary awards based on a comparison of the player symbol set with the gaming system symbol set. The gaming system determines any additional awards based on a comparison of the predicted quantity of symbols with the randomly determined actual quantity of symbols associated with the characteristic associated with the predicted quantity of symbols. The gaming system displays any determined primary awards and any determined additional awards.

It should thus be appreciated that the Keno game of the present disclosure provides an opportunity to win additional awards, which increases the level of excitement and enjoyment for certain players.

Additional features and advantages are described herein, and will be apparent from, the following Detailed Description and the Figures.

BRIEF DESCRIPTION OF THE FIGURES

FIGS. 2A, 2B, 2C, 2D, 2E, and 2F illustrate screen shots of an example embodiment of the gaming system of the present disclosure configured to operate an example of the Keno game of the present disclosure.

DETAILED DESCRIPTION

Keno Game Providing an Additional Award if a Predicted Quantity of Symbols Matches An Actual Quantity of Symbols Associated with One of a Plurality of Different Characteristics Various embodiments of the present disclosure are directed to a gaming system and method providing a Keno game providing an additional award if a predicted quantity of symbols matches an actual quantity of symbols associated with one of a plurality of different characteristics. While the Keno game of the present disclosure is a primary game in the embodiments described below, it should be appreciated that the Keno game may additionally or alternatively be employed as or in association with a secondary game or a bonus game. Moreover, while the credit balances, the wagers, and the awards are displayed as amounts of monetary credits or currency in the embodiments described below, one or more of such credit balances, such wagers, and such awards may be for non-monetary credits, promotional credits, and/or player tracking points or credits.

Figure 1:
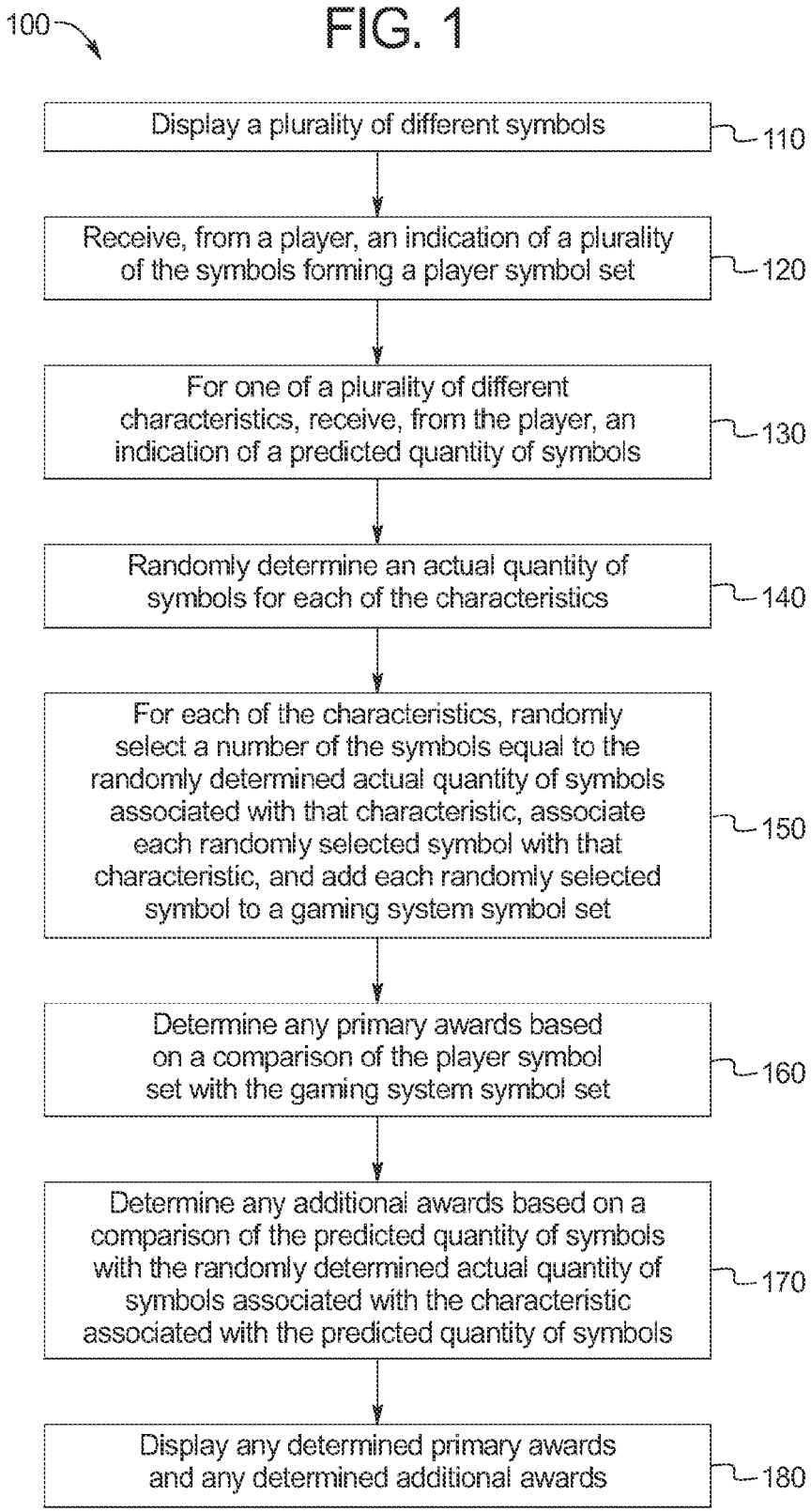
FIG. 1 is a flowchart illustrating an example method of operating an embodiment of the gaming system of the present disclosure.

FIG. 1 illustrates a flowchart of an example process or method 100 of operating the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system displays a plurality of different symbols (such as the numbers 1 through 80), as indicated by block 110. The gaming system receives, from a player, an indication of a plurality of the symbols forming a player symbol set, as indicated by block 120. For one of a plurality of different characteristics, the gaming system receives an indication of a predicted quantity of symbols from the player, as indicated by block 130. More specifically, and as described in detail below, the gaming system receives an indication from the player of how many of the symbols of a gaming system symbol set the player predicts will be associated with that characteristic. The gaming system randomly determines an actual quantity of symbols for each of the characteristics, as indicated by block 140. That is, the gaming system determines, for each of the characteristics, how many of the symbols of the gaming system symbol set will be associated with that characteristic. For each of the characteristics, the gaming system randomly selects a number of the symbols equal to the randomly determined actual quantity of symbols associated with that characteristic, associates each of those randomly selected symbols with that characteristic, and adds each of those randomly selected symbols to the gaming system symbol set, as indicated by block 150.

The gaming system determines any primary awards based on a comparison of the player symbol set with the gaming system symbol set, as indicated by block 160. The gaming system determines any additional awards based on a comparison of the predicted quantity of symbols with the randomly determined actual quantity of symbols associated with the characteristic associated with the predicted quantity of symbols, as indicated by block 170. The gaming system displays any determined primary awards and any determined additional awards, as indicated by block 180.

FIGS. 2A, 2B, 2C, 2D, 2E, and 2F illustrate screen shots of an example embodiment of the gaming system of the present disclosure configured to operate an example of the Keno game. Generally, in this example, if the gaming system receives a primary wager from a player for a play of the Keno game, the gaming system: (a) displays a plurality of different symbols; (b) receives, from the player, an indication of a plurality of the symbols forming a player symbol set; (c) randomly selects a gaming system symbol set and associates one of a plurality of different characteristics with each symbol of the gaming system symbol set; and (d) determines any primary award based on a comparison of the player symbol set and the gaming system symbol set. Further, in this example, if the gaming system receives a secondary or side wager from the player in addition to the primary wager for the play of the Keno game, the gaming system: (a) receives, from the player, for each of the characteristics, an indication of a predicted quantity of symbols; and (b) for each of the characteristics, determines any secondary award associated with that characteristic based on a comparison of the predicted quantity of symbols associated with that characteristic and an actual quantity of the symbols of the gaming system symbol set associated with that characteristic.

In this example embodiment, the symbols are numbers, and the Keno game is associated with the numbers 1 through 80. It should be appreciated that the Keno game may be associated with any suitable numbers or range of numbers, and that the Keno game may employ any suitable symbols (such as letters, characters, themed images, and the like) instead of or in addition to numbers. Additionally, in this example, the characteristics are patterns. Specifically, the Keno game is associated with four different patterns: (1) a diagonal upward (from left to right) pattern, (2) a diagonal downward (from left to right) patter, (3) a horizontal pattern, and (4) a vertical pattern. It should be appreciated that the gaming system may employ any suitable quantity of characteristics and any suitable characteristics, such as: (a) a plurality of different colors; (b) a plurality of different subsymbols; (c) a plurality of different letters; (d) a plurality of different phrases; (e) a plurality of different logos; (f) a plurality of different playing card suits (such as spades, hearts, clubs, and diamonds); (g) a plurality of different playing card ranks (such as Two through Ace); (h) a plurality of different Mahjong tiles; (i) a plurality of different but related pictures (such as pictures of presidents of the United States); (j) a plurality of buildings of different sizes (such as shack, bungalow, house, mansion, duplex, apartment building, skyscraper); (k) a plurality of fish of different sizes and/or types (such as goldfish, trout, salmon, shark, and whale); (l) a plurality of animals of different sizes and/or types (such as Chihuahua, Poodle, Bulldog, Golden Retriever, and St. Bernard); (m) a plurality of different sizes (such as small, medium, large, and extra-large); (n) a plurality of different numbers of a symbol (such as single bar, double bar, and triple bar); (o) a plurality of different orientations (such as pointing left, pointing up, pointing right, and pointing down); (p) a plurality of different categories (such as human, animal, and robot); (q) a plurality of different borders (such as a black border, a dotted border, a dashed border, and an oval border); (r) a plurality of different poses (such as a mug shot, a profile shot, and a full body shot); (s) a plurality of different artistic types (such as a photograph, a watercolor painting, and a cartoon); (t) a plurality of different genders (such as a man or a woman); (u) a plurality of different ages (such as an infant, a child, a teenager, and an adult); (v) a plurality of different outfits (such as a bathing suit, a casual outfit, a suit, and a tuxedo); (w) a plurality of different accessories (such as jewelry, a hat, a scarf, and gloves); (x) a plurality of different Zodiac signs; (y) a plurality of different days of the week; (z) a plurality of different months of the year; (aa) a plurality of different types of fruit; and/or (bb) a plurality of different jewels.

The gaming system displays (such as on a display device 1116 or 1118, described below) a Keno board 200 including a plurality of Keno board positions 201 through 280. The gaming system displays a different one of the numbers 1 through 80 at each of the Keno board positions. The gaming system displays a primary paytable 270, which is blank in FIG. 2A (because the player number set had not yet been determined at that point in time) and described in detail below with respect to FIG. 2B, and a pattern matching area 280. Pattern matching area 280 displays each of the patterns associated with the Keno game. In this example, if the player places a secondary wager for a play of the Keno game, for each of the patterns, the gaming system displays in pattern matching area 280 and in association with that pattern: (a) the predicted quantity of numbers associated with that pattern, (b) the actual quantity of the numbers of the gaming system number set that are associated with that pattern, and (c) the secondary award (if any) associated with that pattern.

The gaming system also displays a message box 291 that displays messages or indications before, during, or after play of the Keno game, and a plurality of meters including: a primary wager meter 292 that displays any primary wager placed by a player for a play of the Keno game; a secondary wager meter 293 that displays any secondary wager placed by the player for the play of the Keno game; a credit meter 294 that displays the player's credit balance; a primary award meter 295 that displays any primary award won for the play of the Keno game; a secondary award meter 296 that displays any secondary award(s) won for the play of the Keno game; and a total award meter 297 that displays the total of any awards won (i.e., the sum of any primary award and any secondary awards won) for the play of the Keno game. While in this illustrated example the gaming system indicates the player's credit balance, the player's wager, and any awards provided to the player in the form of amounts of credits, it should be appreciated that such indications may alternatively or additionally be made in the form of amounts of currency.

Figure 2A:
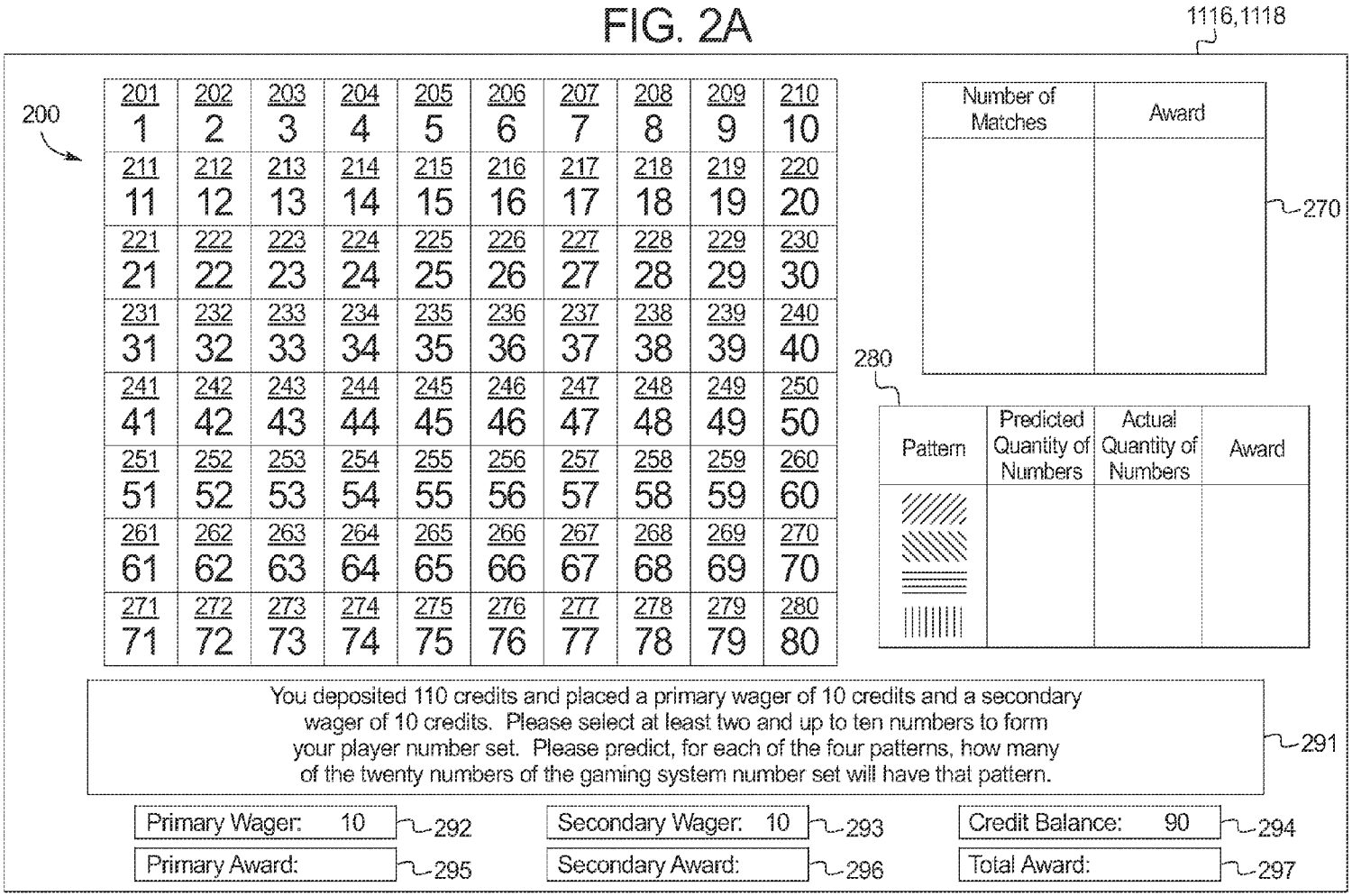

As illustrated in FIG. 2A, the gaming system receives value, such as currency (or its equivalent), from a player. In this example, the gaming system provides the player 110 credits, which represents the received value. The gaming system subsequently receives a primary wager of 10 credits and a secondary wager of 10 credits from the player for a play of the Keno game. The gaming system displays the primary wager of 10 credits in primary wager meter 292 and the secondary wager of 10 credits in secondary wager meter 293. The gaming system displays the player's total remaining credit balance of 90 credits (i.e., the player's initial credit balance of 110 credits less the primary wager of 10 credits and less the secondary wager of 10 credits) in credit meter 294. Since the gaming system received both the primary wager and the secondary wager, the gaming system enables the player to: (a) form the player's player number set by selecting a plurality of the numbers; and (b) for each of the four patterns, predict how many of the twenty numbers of the gaming system number set will be associated with that pattern. The gaming system displays the following message in message box 291: "YOU DEPOSITED 110 CREDITS AND PLACED A PRIMARY WAGER OF 10 CREDITS AND A SECONDARY WAGER OF 10 CREDITS. PLEASE SELECT AT LEAST TWO AND UP TO TEN NUMBERS TO FORM YOUR PLAYER NUMBER SET. PLEASE INDICATE, FOR EACH OF THE FOUR PATTERNS, HOW MANY OF THE TWENTY NUMBERS OF THE GAMING SYSTEM NUMBER SET YOU PREDICT WILL HAVE THAT PATTERN."

Figure 2B:
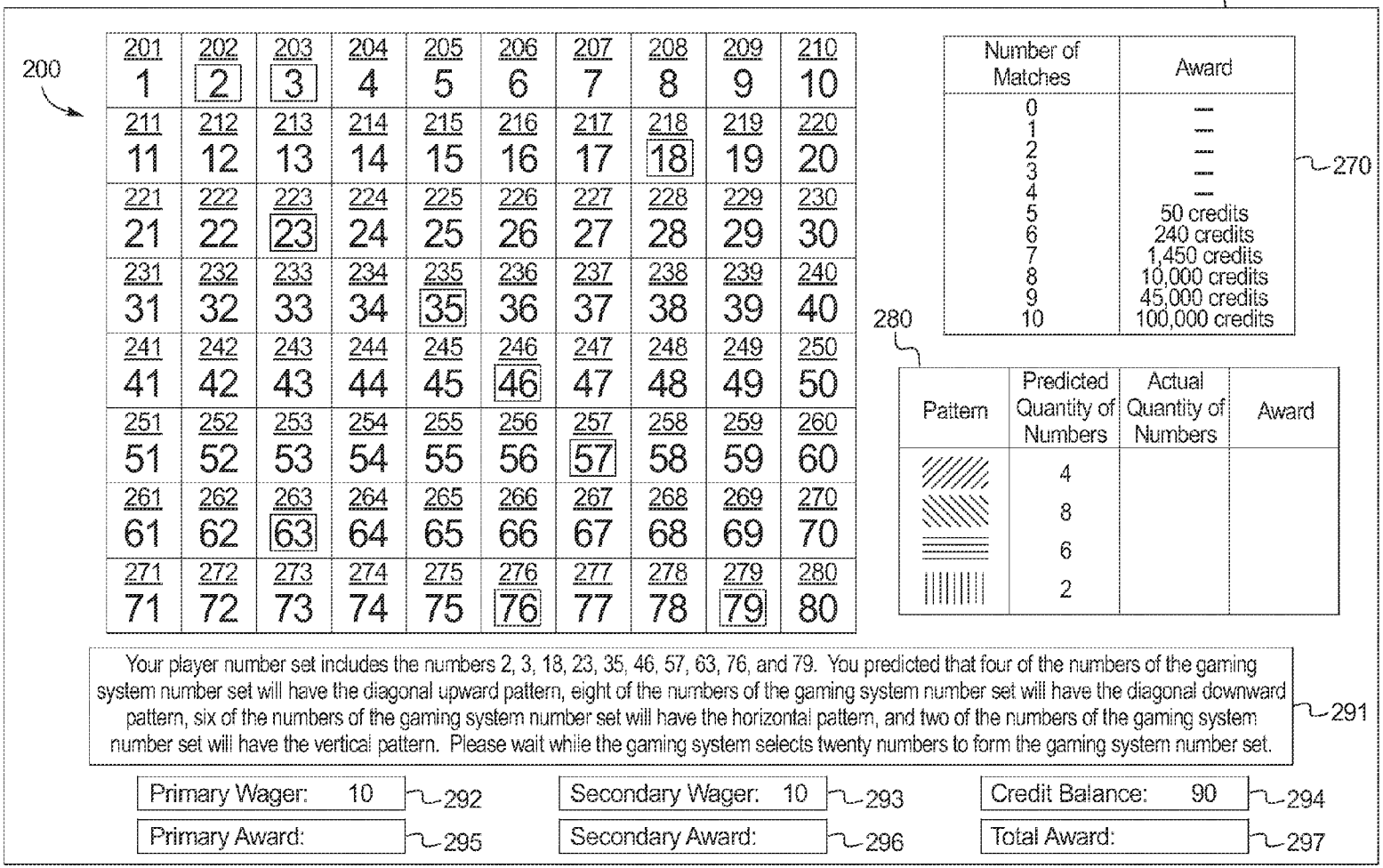

In this example, the gaming system enables the player to select between two and ten of the numbers to form the player number set. Here, as illustrated in FIG. 2B, the gaming system receives an indication of the following ten of the numbers forming the player number set: 2, 3, 18, 23, 35, 46, 57, 63, 76, and 79. The numbers included in the player number set are each boxed for clarity in FIGS. 2B, 2C, 2D, 2E, and 2F. Additionally, because the gaming system received the secondary wager, the gaming system enables the player to, for each of the four patterns, predict how many of the twenty numbers of the gaming system number set will be associated with that patter. That is, for each pattern, the gaming system receives an indication of a number between zero and twenty, which represents the quantity of the twenty numbers of the gaming system number set the player predicts will be associated with that pattern. Here, as illustrated in FIG. 2B, the gaming system receives: (a) an indication that the player predicts a quantity of four of the twenty numbers of the gaming system number set will be associated with the diagonal upward pattern, (b) an indication that the player predicts a quantity of eight of the twenty numbers of the gaming system number set will be associated with the diagonal downward pattern, (c) an indication that the player predicts a quantity of six of the twenty numbers of the gaming system number set will be associated with the horizontal pattern, and (d) an indication that the player predicts a quantity of two of the twenty numbers of the gaming system number set will be associated with the vertical pattern.

The gaming system displays, in patter matching area 280, the predicted quantity of four numbers in association with the diagonal upward patter, the predicted quantity of eight numbers in association with the diagonal downward pattern, the predicted quantity of six numbers in association with the horizontal pattern, and the predicted quantity of two numbers in association with the vertical pattern. The gaming system displays the following message in message box 291: "YOUR PLAYER NUMBER SET INCLUDES THE NUMBERS 2, 3, 18, 23, 35, 46, 57, 63, 76, AND 79. YOU PREDICTED THAT FOUR OF THE NUMBERS OF THE GAMING SYSTEM NUMBER SET WILL HAVE THE DIAGONAL UPWARD PATTERN, EIGHT OF THE NUMBERS OF THE GAMING SYSTEM NUMBER SET WILL HAVE THE DIAGONAL DOWNWARD PATTERN, SIX OF THE NUMBERS OF THE GAMING SYSTEM NUMBER SET WILL HAVE THE HORIZONTAL PATTERN, AND TWO OF THE NUMBERS OF THE GAMING SYSTEM NUMBER SET WILL HAVE THE VERTICAL PATTERN. PLEASE WAIT WHILE THE GAMING SYSTEM SELECTS TWENTY NUMBERS TO FORM THE GAMING SYSTEM NUMBER SET."

As noted above, the gaming system displays primary paytable 270 and employs primary paytable 270 to determine any primary awards for the play of the Keno game based on a quantity of the numbers in the player number set that match numbers included in the gaming system number set. Accordingly, primary paytable 270 indicates a plurality of quantities of matches and, for each quantity of matches, a primary award associated with that quantity of matches. In this example, primary paytable 270 indicates a credit payout associated with each respective quantity of matches when: (a) a 10 credit primary wager is placed for a play of the Keno game, (b) the player number set includes ten numbers, and (c) the gaming system number set includes twenty numbers. It should be appreciated that the paytable may vary when one or more of: (a) a primary wager other than a 10 credit wager is placed, (b) the player number set includes more than or less than ten numbers, and (c) the gaming system number set includes more than or less than twenty numbers.

Generally, in this example, the gaming system randomly determines how many of the twenty numbers of the gaming system number set will be associated with each of the four patterns and, for each of the patterns, randomly determines which of the numbers to associate with that pattern and to include in the gaming system number set. Put differently, in this example, the gaming system forms the gaming system number set by: (a) randomly determining an actual quantity of numbers for each of the patterns; and (b) for each of the patterns: (1) randomly selecting a number of the numbers equal to the randomly determined actual quantity of numbers associated with that pattern, (2) associating each of those randomly selected numbers with that pattern, and (3) adding each of those randomly selected numbers to the gaming system number set. In this example, for each of the patterns, the actual quantity may be any number from zero to twenty. It should be appreciated that, in other embodiments, the actual quantity for each of the patterns is at least one.

For instance, in an example in which the Keno game is associated with only a first and a second pattern, the gaming system: (a) randomly determines that fifteen of the twenty numbers of the gaming system number set will be associated with the first patter and that five of the twenty numbers of the gaming system number set will be associated with the second pattern; (b) for the first patter: (1) randomly determines fifteen of the eighty numbers, (2) associates the fifteen randomly determined numbers with the first pattern, and (3) adds the fifteen randomly determined numbers to the gaming system number set; and (c) for the second patter: (1) randomly determines five of the eighty numbers, (2) associates the five randomly determined numbers with the second pattern, and (3) adds the five randomly determined numbers to the gaming system number set.

Figure 2C:
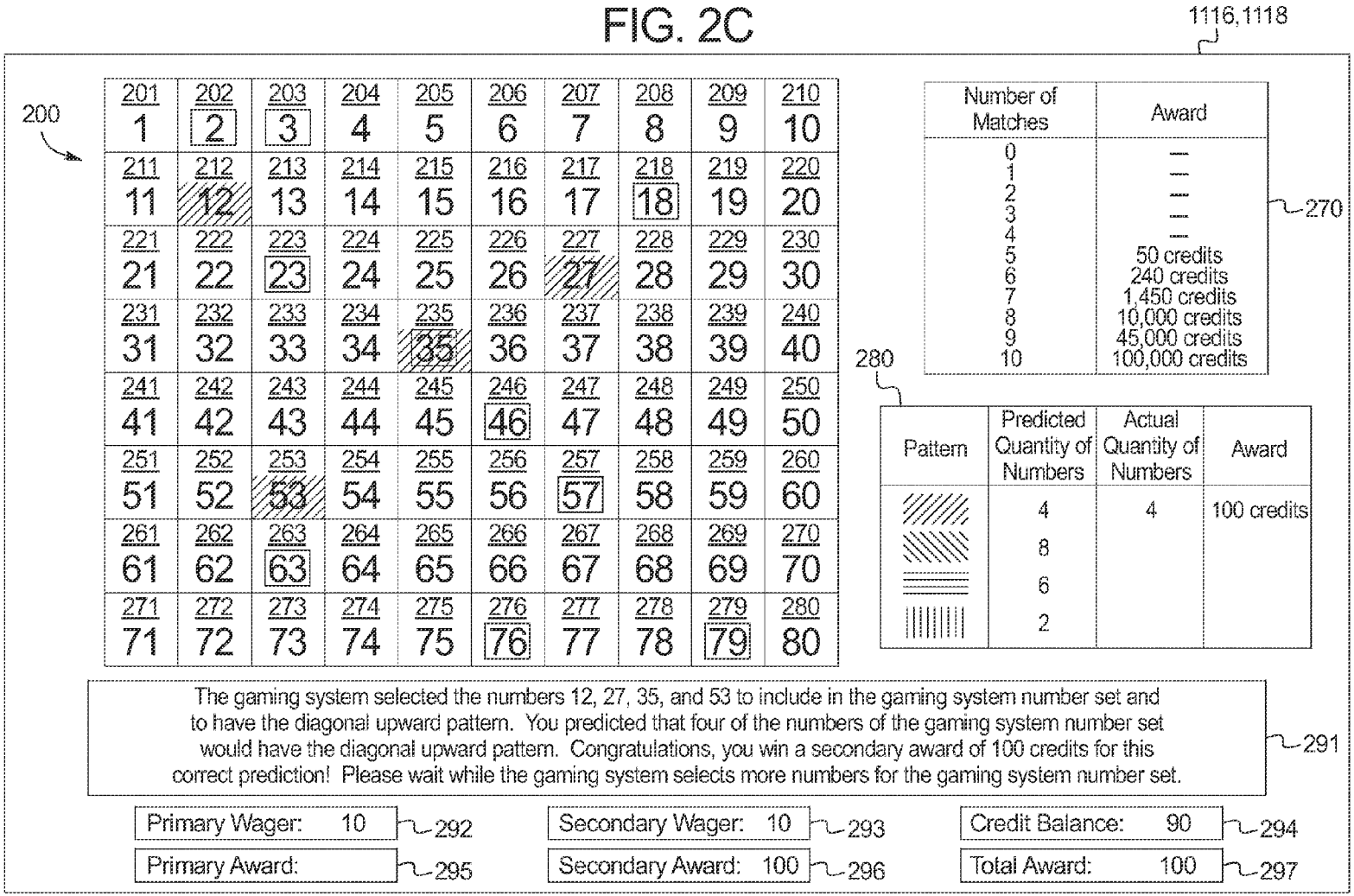

Returning to the illustrated example, and as illustrated in FIG. 2C, for the diagonal upward patter, the gaming system: (a) randomly determines an actual quantity of four numbers (i.e., that four of the twenty numbers of the gaming system number set will be associated with the diagonal upward pattern); (b) randomly selects the numbers 12, 27, 35, and 53 (i.e., randomly selects a number of the numbers equal to the randomly determined actual quantity of four numbers); (c) associates each of those randomly selected numbers with the diagonal upward pattern and displays the diagonal upward pattern in association with the Keno board positions associated with those numbers; and (d) adds those randomly selected numbers to the gaming system number set. The gaming system displays the randomly determined actual quantity of four numbers in pattern matching area 280 in association with the diagonal upward pattern. At this point in time, the gaming system number set includes the numbers 12, 27, 35, and 53.

It should be appreciated that, in this example, each of the numbers may be associated with only one of the characteristics. In other embodiments, however, one or more of the symbols may be associated with a plurality of the characteristics.

The gaming system determines whether the actual quantity of numbers of the gaming system number set associated with the diagonal upward pattern matches the predicted quantity of numbers associated with the diagonal upward patter. If so, the gaming system determines a secondary award associated with the diagonal upward pattern of ten times the secondary wager. If not, the gaming system determines that no secondary award is associated with the diagonal upward pattern. In this example, the actual quantity of four numbers of the gaming system number set associated with the diagonal upward pattern matches the predicted quantity of four numbers associated with the diagonal upward pattern. Accordingly, the gaming system determines a secondary award of 100 credits associated with the diagonal upward pattern, and updates secondary award meter 296 and the total award meter 297 to reflect the secondary award of 100 credits. The gaming system displays the following message in message box 291: "THE GAMING SYSTEM SELECTED THE NUMBERS 12, 27, 35, AND 53 TO INCLUDE IN THE GAMING SYSTEM NUMBER SET AND TO HAVE THE DIAGONAL UPWARD PATTERN. YOU PREDICTED THAT FOUR OF THE NUMBERS OF THE GAMING SYSTEM NUMBER SET WOULD HAVE THE DIAGONAL UPWARD PATTERN. CONGRATULATIONS, YOU WIN A SECONDARY AWARD OF 100 CREDITS FOR THIS CORRECT PREDICTION! PLEASE WAIT WHILE THE GAMING SYSTEM SELECTS MORE NUMBERS FOR THE GAMING SYSTEM NUMBER SET."

Figure 2D:
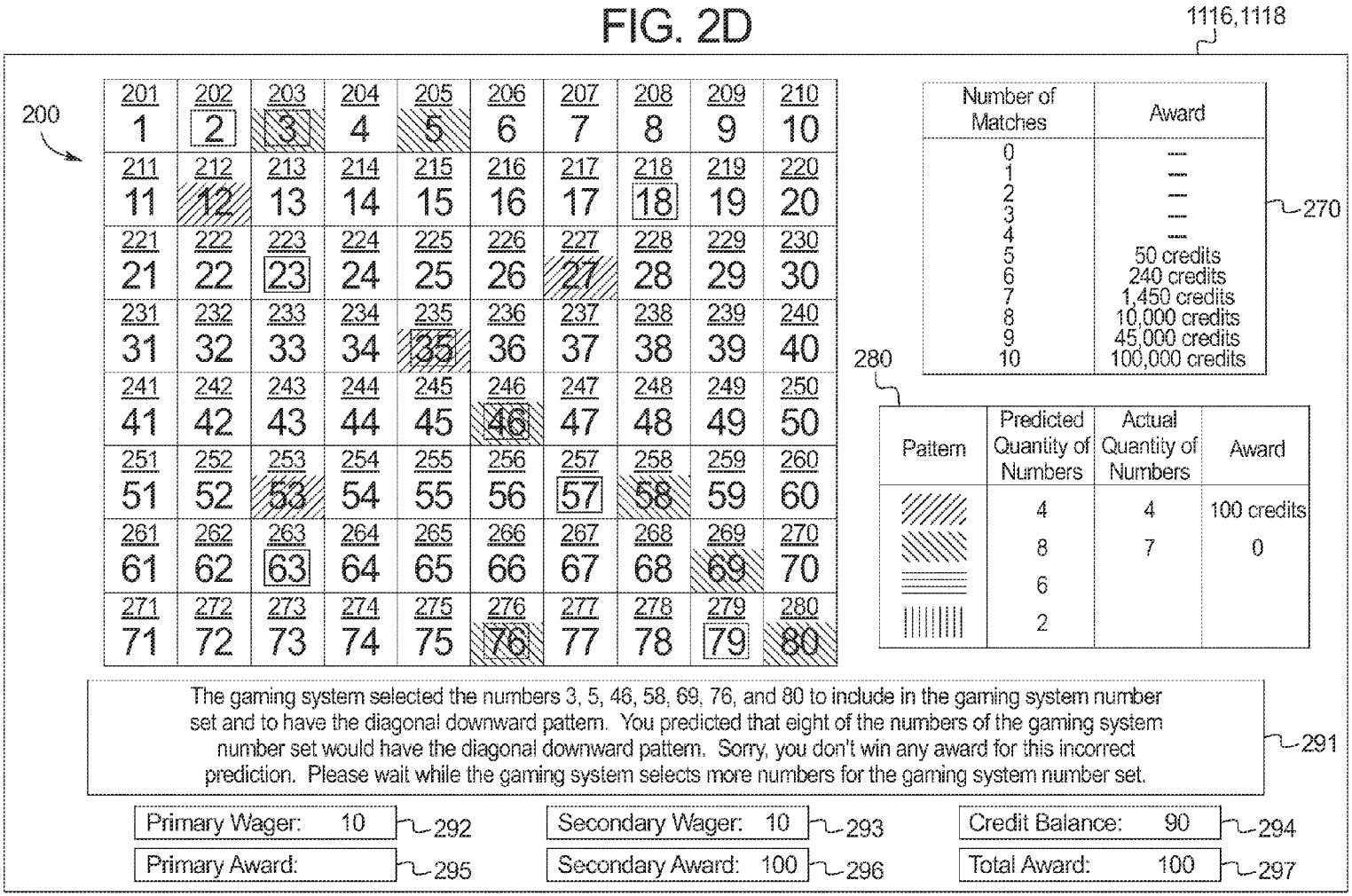

As illustrated in FIG. 2D, for the diagonal downward pattern, the gaming system: (a) randomly determines an actual quantity of seven numbers (i.e., that seven of the twenty numbers of the gaming system number set will be associated with the diagonal downward pattern); (b) randomly selects the numbers 3, 5, 46, 58, 69, 76, and 80 (i.e., randomly selects a number of the numbers equal to the randomly determined actual quantity of seven numbers); (c) associates each of those randomly selected numbers with the diagonal downward pattern and displays the diagonal downward patter in association with the Keno board positions associated with those numbers; and (d) adds those randomly selected numbers to the gaming system number set. The gaming system displays the randomly determined actual quantity of seven numbers in pattern matching area 280 in association with the diagonal downward pattern. At this point in time, the gaming system number set includes the numbers 3, 5, 12, 27, 35, 46, 53, 58, 69, 76, and 80.

The gaming system determines whether the actual quantity of numbers of the gaming system number set associated with the diagonal downward pattern matches the predicted quantity of numbers associated with the diagonal downward pattern. If so, the gaming system determines a secondary award associated with the diagonal downward pattern of ten times the secondary wager. If not, the gaming system determines that no secondary award is associated with the diagonal downward pattern. In this example, the actual quantity of seven numbers of the gaming system number set associated with the diagonal downward pattern does not match the predicted quantity of eight numbers associated with the diagonal downward pattern. Accordingly, the gaming system determines that no secondary award is associated with the diagonal downward pattern. The gaming system displays the following message in message box 291: "THE GAMING SYSTEM SELECTED THE NUMBERS 3, 5, 46, 58, 69, 76, AND 80 TO INCLUDE IN THE GAMING SYSTEM NUMBER SET AND TO HAVE THE DIAGONAL DOWNWARD PATTERN. YOU PREDICTED THAT EIGHT OF THE NUMBERS OF THE GAMING SYSTEM NUMBER SET WOULD HAVE THE DIAGONAL DOWNWARD PATTERN. SORRY, YOU DON'T WIN ANY AWARD FOR THIS INCORRECT PREDICTION. PLEASE WAIT WHILE THE GAMING SYSTEM SELECTS MORE NUMBERS FOR THE GAMING SYSTEM NUMBER SET."

As illustrated in FIG. 2E, for the horizontal pattern, the gaming system: (a) randomly determines an actual quantity of six numbers (i.e., that six of the twenty numbers of the gaming system number set will be associated with the horizontal pattern); (b) randomly selects the numbers 2, 14, 23, 34, 57, and 63 (i.e., randomly selects a number of the numbers equal to the randomly determined actual quantity of six numbers); (c) associates each of those randomly selected numbers with the horizontal pattern and displays the horizontal pattern in association with the Keno board positions associated with those numbers; and (d) adds those randomly selected numbers to the gaming system number set. The gaming system displays the randomly determined actual quantity of six numbers in pattern matching area 280 in association with the horizontal pattern. At this point in time, the gaming system number set includes the numbers 2, 3, 5, 12, 14, 23, 27, 34, 35, 46, 53, 57, 58, 63, 69, 76, and 80.

The gaming system determines whether the actual quantity of numbers of the gaming system number set associated with the horizontal pattern matches the predicted quantity of numbers associated with the horizontal pattern. If so, the gaming system determines a secondary award associated with the horizontal pattern of ten times the secondary wager. If not, the gaming system determines that no secondary award is associated with the horizontal pattern. In this example, the actual quantity of six numbers of the gaming system number set associated with the horizontal pattern matches the predicted quantity of six numbers associated with the horizontal pattern. Accordingly, the gaming system determines a secondary award of 100 credits associated with the horizontal pattern, and updates secondary award meter 296 and the total award meter 297 to reflect the secondary award of 100 credits. The gaming system displays the following message in message box 291: "THE GAMING SYSTEM SELECTED THE NUMBERS 2, 14, 23, 34, 57, AND 63 TO INCLUDE IN THE GAMING SYSTEM NUMBER SET AND TO HAVE THE HORIZONTAL PATTERN. YOU PREDICTED THAT SIX OF THE NUMBERS OF THE GAMING SYSTEM NUMBER SET WOULD HAVE THE HORIZONTAL PATTERN. CONGRATULATIONS, YOU WIN A SECONDARY AWARD OF 100 CREDITS FOR THIS CORRECT PREDICTION! PLEASE WAIT WHILE THE GAMING SYSTEM SELECTS MORE NUMBERS FOR THE GAMING SYSTEM NUMBER SET."

Figure 2F:
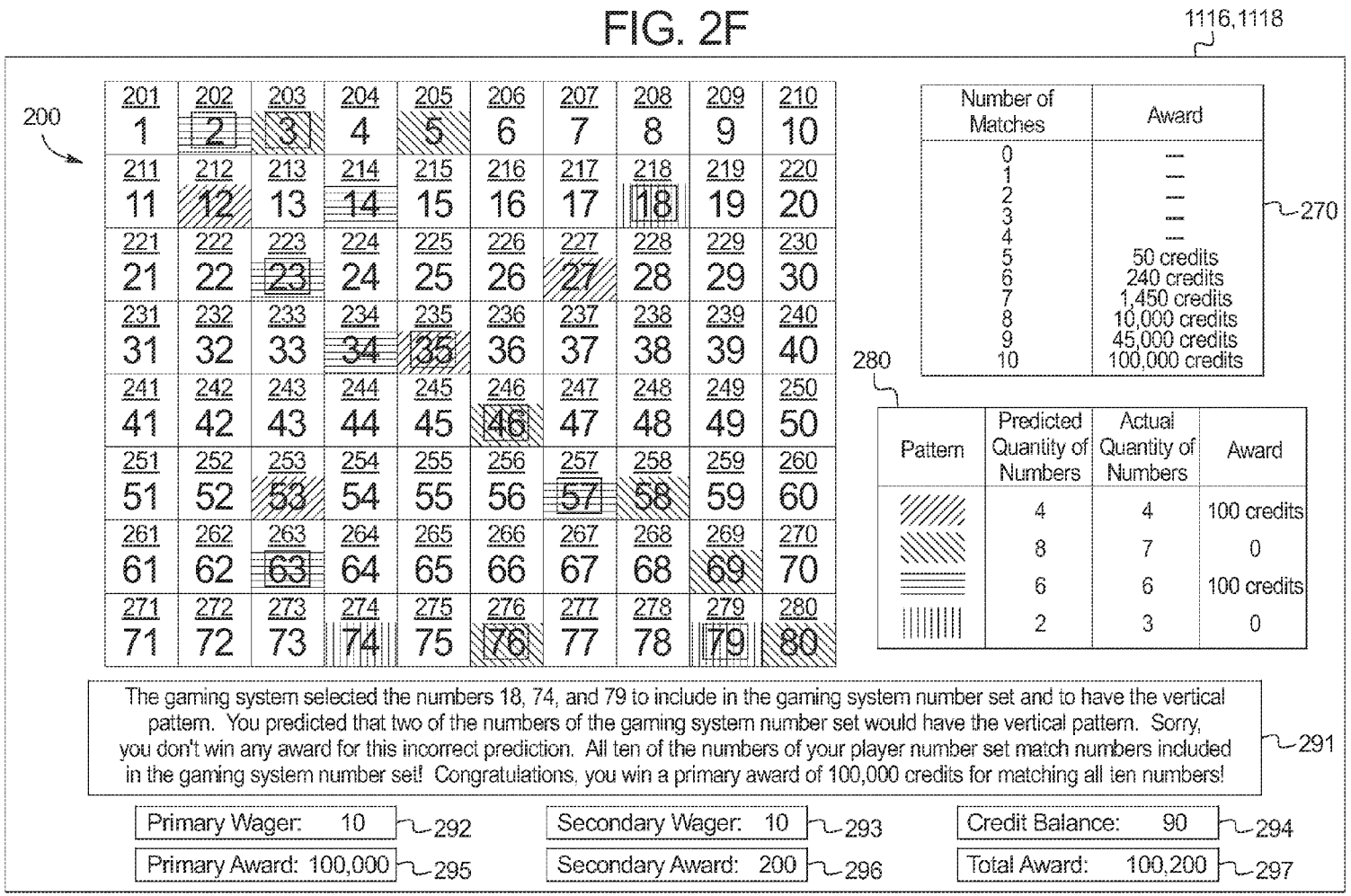

As illustrated in FIG. 2F, for the vertical pattern, the gaming system: (a) randomly determines an actual quantity of three numbers (i.e., that three of the twenty numbers of the gaming system number set will be associated with the vertical pattern); (b) randomly selects the numbers 18, 74, and 79 (i.e., randomly selects a number of the numbers equal to the randomly determined actual quantity of three numbers); (c) associates each of those randomly selected numbers with the vertical pattern and displays the vertical pattern in association with the Keno board positions associated with those numbers; and (d) adds those randomly selected numbers to the gaming system number set. The gaming system displays the randomly determined actual quantity of three numbers in pattern matching area 280 in association with the vertical pattern. At this point in time, the gaming system number set includes the numbers 2, 3, 5, 12, 14, 18, 23, 27, 34, 35, 46, 53, 57, 58, 63, 69, 74, 76, 79, and 80. This completes the gaming system number set.

The gaming system determines whether the actual quantity of numbers of the gaming system number set associated with the vertical pattern matches the predicted quantity of numbers associated with the vertical pattern. If so, the gaming system determines a secondary award associated with the vertical pattern of ten times the secondary wager. If not, the gaming system determines that no secondary award is associated with the vertical patter. In this example, the actual quantity of three numbers of the gaming system number set associated with the vertical pattern does not match the predicted quantity of two numbers associated with the vertical pattern. Accordingly, the gaming system determines that no secondary award is associated with the vertical pattern.

Since the gaming system number set is complete, the gaming system determines any primary award by comparing the player number set with the gaming system number set to determine a quantity of matches. More specifically, the gaming system determines how many of the numbers in the player number set match numbers included in the gaming system number set. In this example, the gaming system determines that all ten of the numbers of the player number set match numbers included in the gaming system number set. Thus, the quantity of matches for this play of the Keno game is equal to ten. The gaming system determines a primary award of 100,000 credits based on primary paytable 270, and updates primary award meter 295 and the total award meter 297 to reflect the primary award of 100,000 credits. The gaming system displays the following message in message box 291: "THE GAMING SYSTEM SELECTED THE NUMBERS 18, 74, AND 79 TO INCLUDE IN THE GAMING SYSTEM NUMBER SET AND TO HAVE THE VERTICAL PATTERN. YOU PREDICTED THAT TWO OF THE NUMBERS OF THE GAMING SYSTEM NUMBER SET WOULD HAVE THE VERTICAL PATTERN. SORRY, YOU DON'T WIN ANY AWARD FOR THIS INCORRECT PREDICTION.

ALL TEN OF THE NUMBERS OF YOUR PLAYER NUMBER SET MATCH NUMBERS INCLUDED IN THE GAMING SYSTEM NUMBER SET! CONGRATULATIONS, YOU WIN A PRIMARY AWARD OF 100,000 CREDITS FOR MATCHING ALL TEN NUMBERS!"

In one embodiment, the gaming system displays the selection of the gaming system symbol set (and the association of each of the symbols in the gaming system number set with one of the characteristics) by, for each characteristic, displaying a ball or other object having or otherwise associated with that characteristic bouncing on or otherwise interacting with the Keno board. For each symbol on which that ball bounces, the gaming system: (a) associates that symbol with that characteristic, and (b) adds that symbol to the gaming system symbol set. In one example, the Keno game is associated with symbols including the numbers 1 through 80 and four different characteristics including the colors green, red, orange, and yellow. In this example, the gaming system displays a green ball, a red ball, an orange ball, and a yellow ball bouncing on the Keno board. For each number on which one of the balls bounces, the gaming system: (a) associates that number with the color of that ball, and (b) adds that number to the gaming system number set.

In certain embodiments, the gaming system associates each of the symbols of the gaming system symbol set with one of the characteristics. In other embodiments, however, the gaming system may associate fewer than all of the symbols of the gaming system symbol set with one of the characteristics.

In various embodiments, the gaming system enables the player to indicate how many of the symbols of the gaming system symbol set the player predicts will be associated with at least one of a plurality of but less than all of the characteristics. For instance, if the Keno game is associated with four characteristics including four colors blue, red, orange, and yellow, the gaming system enables the player to indicate how many of the symbols of the gaming system symbol set the player predicts will be associated with at least one of the colors blue and red (or any suitable set of at least two of the colors). In other embodiments, the gaming system enables the player to indicate how many of the symbols of the gaming system symbol set the player predicts will be associated with one of the characteristics.

In certain embodiments, the gaming system requires the player to place a secondary wager associated with each distinct predicted quantity of symbols for which the gaming system may provide an additional award. For example, if the player desires to input a distinct predicted quantity of symbols for each of four different characteristics, the gaming system requires the player to place a distinct secondary wager associated with each predicted quantity of symbols. For instance, if the Keno game is associated with four characteristics including four colors blue, red, orange, and yellow, and the player desires to input a distinct predicted quantity of symbols for each of the different colors, the gaming system requires the player to place four distinct secondary wagers, one associated with each of the colors blue, red, orange, and yellow. In other embodiments, the gaming system does not require the player to place any secondary wager to win any additional awards. That is, in this example, the gaming system enables the player to input one or more predictions and win one or more associated additional awards without placing any secondary wagers.

In certain embodiments, the Keno game is associated with a maximum quantity of predictions that the gaming system enables the player to input. For instance, if the maximum quantity of predictions is one, the gaming system only enables the player to input one predicted quantity of symbols. In another example, if the maximum quantity of predictions is three, the gaming system only enables the player to input up to three different predicted quantities of symbols.

In the example described above with respect to FIGS. 2A to 2F, for a given characteristic, the gaming system provides an additional award associated with that characteristic if the predicted quantity of symbols exactly matches the actual quantity of the symbols of the gaming system number set associated with that characteristic. In certain embodiments, the gaming system provides an additional award associated with that characteristic if the predicted quantity of symbols is within a designated range including the actual quantity of the symbols of the gaming system number set associated with that characteristic. In one such embodiment, the additional award is lower the further the predicted quantity of symbols is from the actual quantity of the symbols. In one such example, the gaming system provides a first additional award if the predicted quantity of symbols exactly matches the actual quantity of the symbols of the gaming system number set associated with that characteristic, and a second lower additional award if the predicted quantity of symbols is within two of the actual quantity of the symbols of the gaming system number set associated with that characteristic. In another such embodiment, the additional award is the same regardless of where the predicted quantity of symbols falls within the range.

In certain embodiments, the gaming system provides an additional award associated with a characteristic if the predicted quantity of symbols is greater than or equal to the actual quantity of the symbols of the gaming system number set associated with that characteristic. In other embodiments, the gaming system provides an additional award associated with that characteristic if the predicted quantity of symbols is less than or equal to the actual quantity of the symbols of the gaming system number set associated with that characteristic.

In various embodiments, a sum of the predicted quantities of symbols equals the total quantity of symbols in the gaming system number set. In certain embodiments, the sum of the predicted quantities of symbols is less than or equal to the total quantity of symbols in the gaming system number set. In other embodiments, the sum of the predicted quantities of symbols is greater than or equal to the total quantity of symbols in the gaming system number set. In further embodiments, the sum of the predicted quantities of symbols is greater than the total quantity of symbols in the gaming system number set.

In certain embodiments, for one of the characteristics, the gaming system enables the player to indicate a quantity of symbols that the player predicts will be both: (a) associated with that characteristic and included in the gaming system symbol set, and (b) included in the player symbol set. That is, in these embodiments, the gaming system enables the player to predict how many matching symbols will be associated with a given characteristic. For instance, the gaming system receives an indication from the player that the player predicts three symbols will be both: (a) associated with the color blue (i.e., a characteristic) and included in the gaming system symbol set; and (b) included in the player symbol set. In this example, the gaming system provides the player an additional award if three matching numbers are associated with the color blue.

In various embodiments, the gaming system enables a player to select which specific symbols to include in the player symbol set. In one such embodiment, the gaming system enables the player to select at least a first quantity of the symbols but no more than a second greater quantity of the symbols. In one example, the gaming system enables the player to select at least four of the symbols but no more than ten of the symbols to form the player symbol set. In another example, the gaming system enables the player to select at least one of the symbols but no more than fifteen of the symbols to form the player symbol set. It should be appreciated that the gaming system may enable the player to select any suitable quantity of the symbols or any suitable quantity of the symbols within any suitable range of quantities. In another embodiment, the gaming system enables the player to instruct the gaming system to randomly select one or more of the symbols to include in the player symbol set. That is, in this embodiment, the gaming system selects which specific symbols to include in the player symbol set.

In the example described above with respect to FIGS. 2A to 2F, the gaming system selects a designated quantity of twenty of the symbols to include in the gaming system symbol set, though it should be appreciated that the designated quantity may be any suitable quantity. In certain embodiments, the designated quantity of the symbols is greater than a quantity of the symbols in the player symbol set. In other embodiments, the designated quantity of the symbols is equal to the quantity of the symbols in the player symbol set. In further embodiments, the designated quantity of the symbols is less than the quantity of the symbols in the player symbol set. In one embodiment, the gaming system selects an additional symbol to include in the gaming system symbol set whenever the gaming system selects a symbol that is already included in the gaming system symbol set.

In various embodiments, the gaming system does not require the player to predict how many of the symbols of the gaming system symbol set will be associated with a given characteristic. Rather, in these embodiments, the gaming system receives an indication of one (or more that one, in certain embodiments) of the characteristics, and determines any additional awards associated with that indicated characteristic based on the actual quantity of symbols associated with that indicated characteristic and an associated paytable. In one embodiment, the larger the actual quantity of symbols associated with that characteristic, the larger or more lucrative the additional award. For instance, in one example, the gaming system receives an indication of the color blue (i.e., a characteristic). The gaming system determines an actual quantity of twelve of the symbols to associate with the color blue. The gaming system employs the example paytable shown in Table 1 below to determine an additional award of 40 credits associated with the color blue.

TABLE 1

Example Paytable

| Actual Quantity of Symbols Having the Color Blue | Additional Award (credits) |
|---|---|
| 8 | 20 |
| 9 | 30 |
| 10 to 14 | 40 |
| 15 to 19 | 1,000 |
| 20 | 10,000 |

It should be appreciated that:

(a) the total quantity of symbols;

(b) the specific symbols associated with the Keno game;

(c) whether the gaming system enables the player to input one or more predictions of how many symbols of the gaming system symbol set will be associated with one or more characteristics;

(d) the quantity of characteristics associated with the Keno game;

(e) the specific characteristics associated with the Keno game;

(f) the maximum and minimum quantities of symbols in the player symbol set;

(g) the quantity of symbols in the gaming system symbol set;

(h) the primary awards included in the primary paytable associated with the Keno game;

(i) the additional award(s) associated with the predicted quantity (quantities) of symbols;

(j) the maximum quantity of predictions the gaming system enables the player to input;

(k) the types of predictions the gaming system enables the player to input;

(l) how the symbols of the gaming system symbol set and/or the symbols of the player symbol set are determined;

(m) whether the gaming system enables the player to predict any quantities of symbols or pick one of the symbols; and/or (n) any other suitable variable or determination described herein may be: (1) predetermined; (2) randomly determined; (3) randomly determined based on one or more weighted percentages; (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate the primary game and/or any bonus game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager; (17) determined independent of the player's primary game wager; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
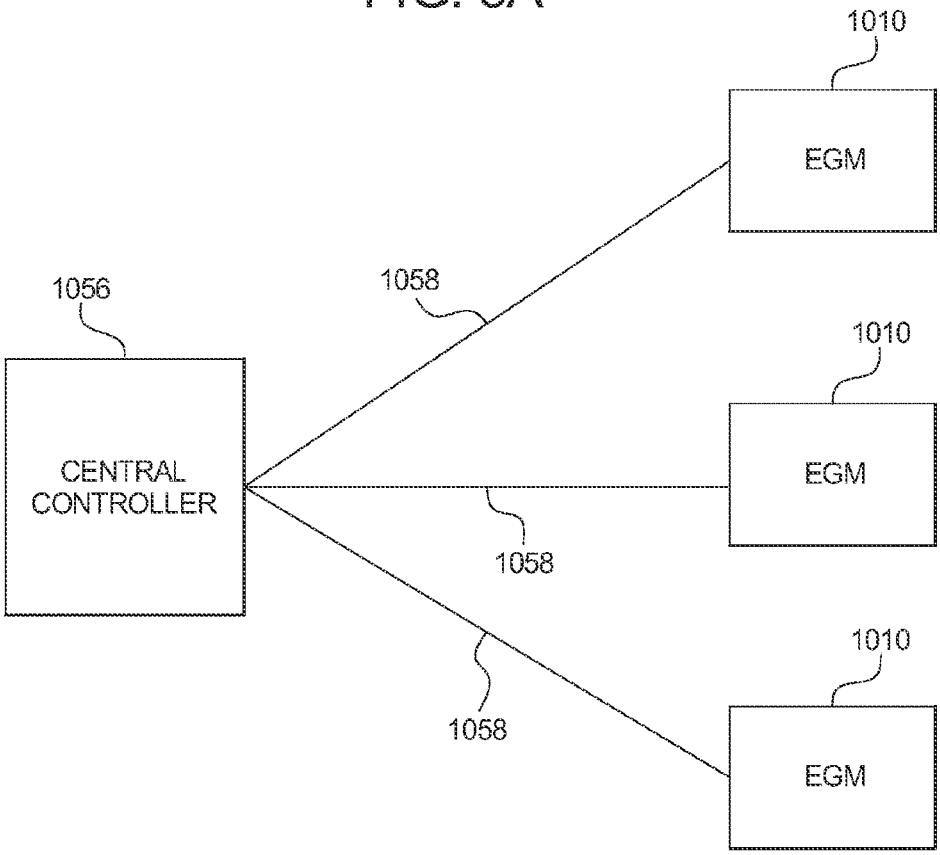
FIG. 3A is a schematic block diagram of an example network configuration of one embodiment of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
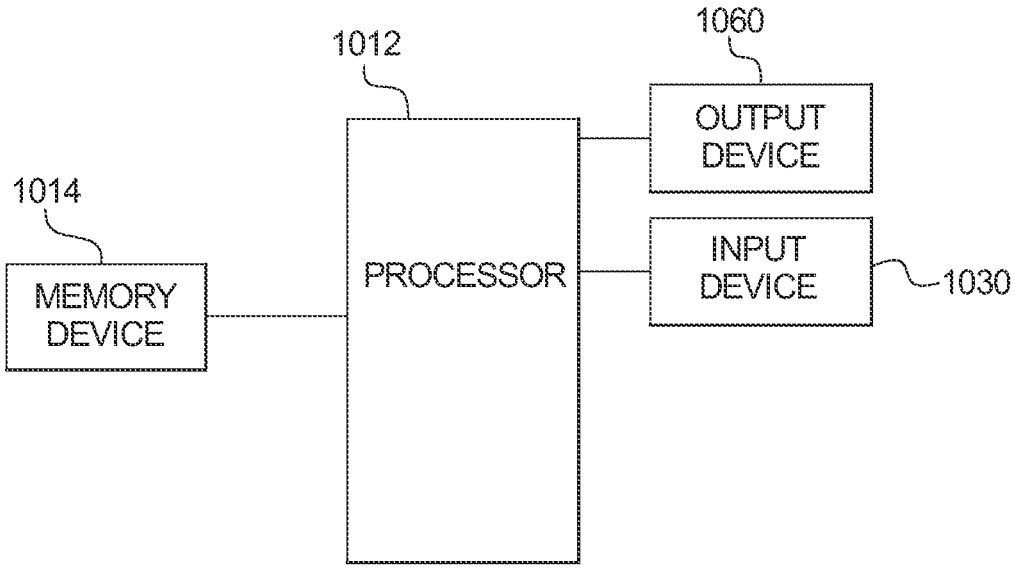
FIG. 3B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
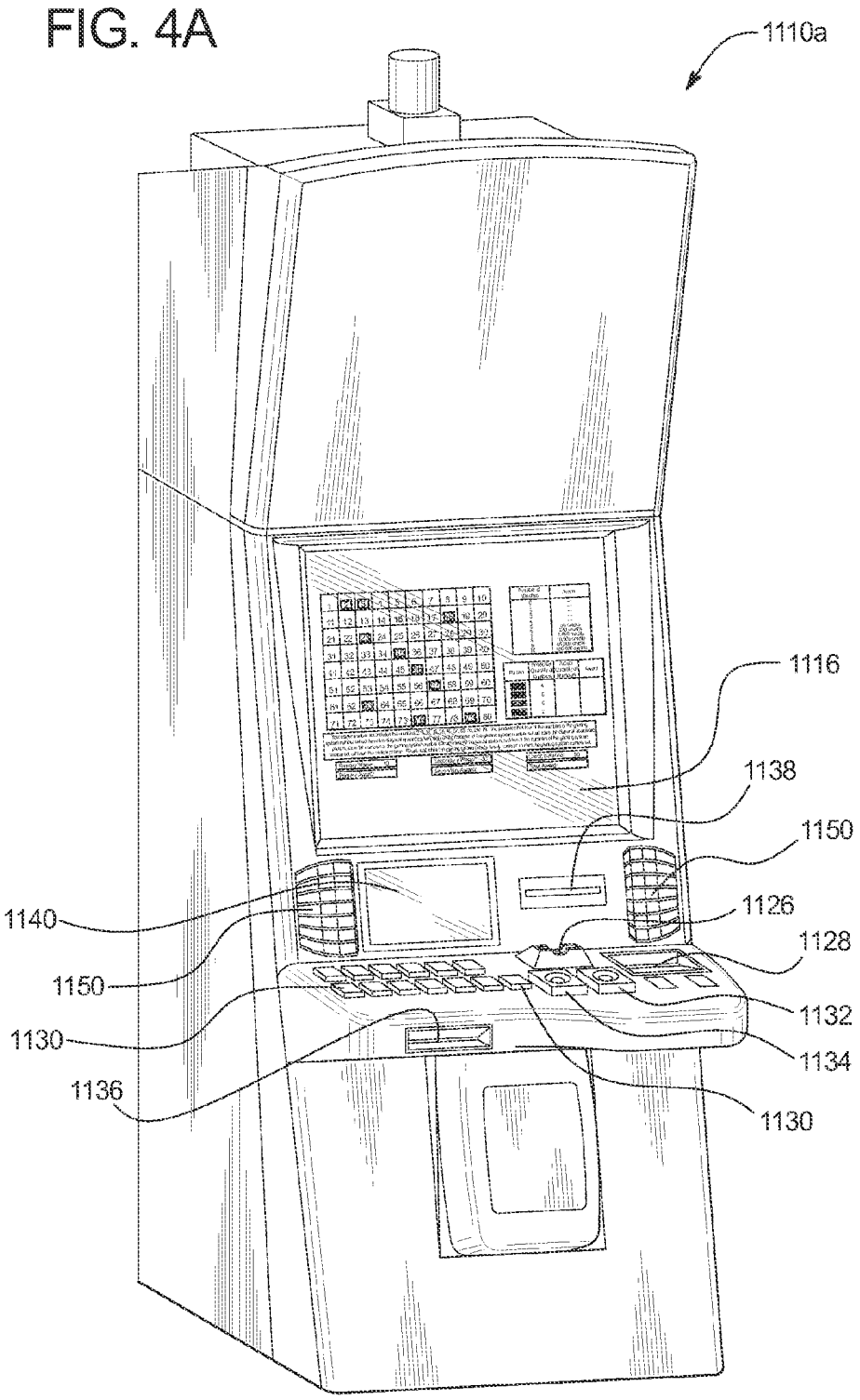
FIGS. 4A and 4B are perspective views of example alternative embodiments of the gaming system of the present disclosure.
Figure 4B:
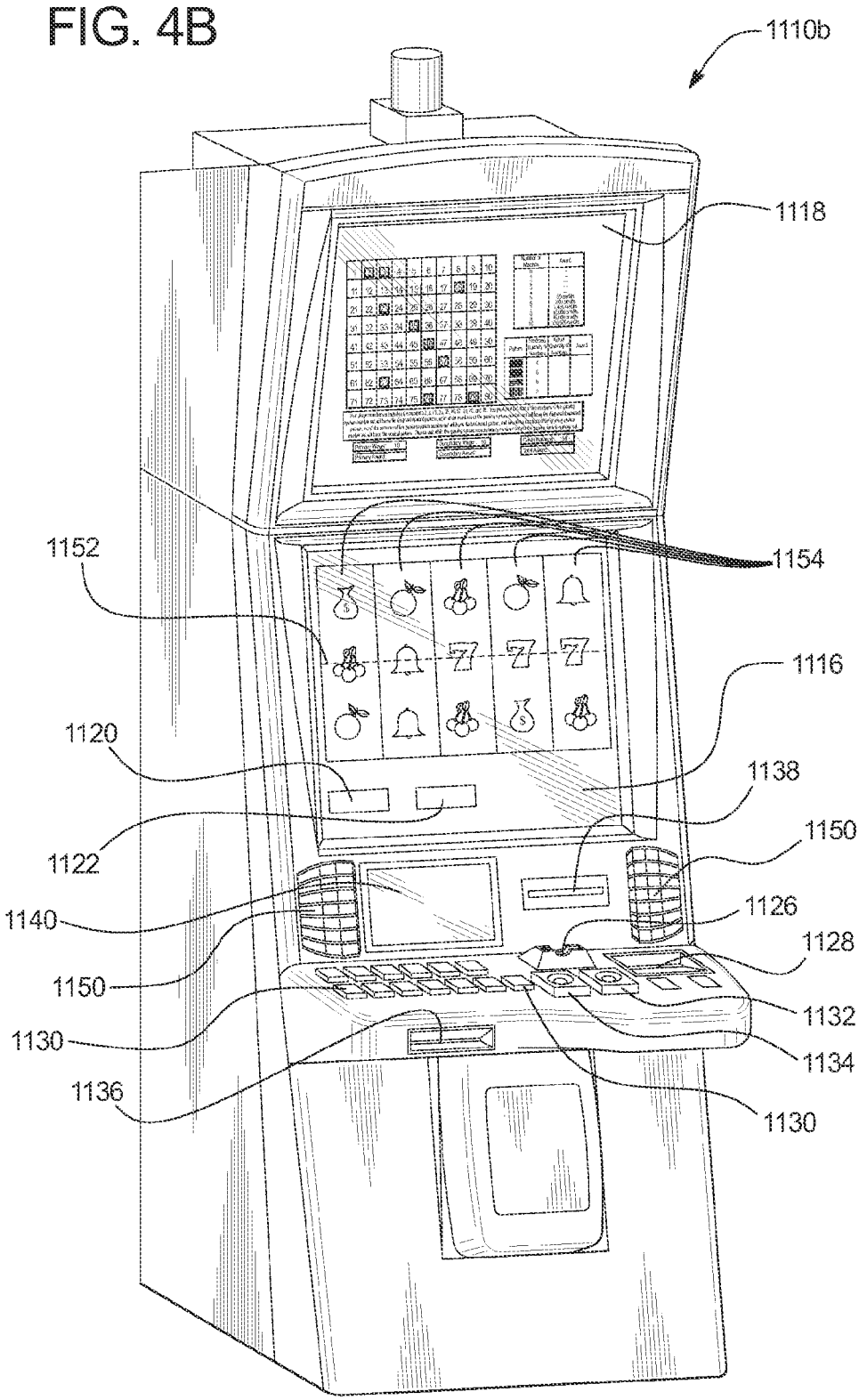

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116 and a player tracking display 1140. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM shown in FIG. 4B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor;

at least one display device;

at least one input device; and at least one memory device storing a plurality of instructions which, when executed by the at least one processor, cause the at least one processor to operate with the at least one display device and the at least one input device, for a play of a game, to:

(a) display a plurality of different symbols and an indication of each of a plurality of different characteristics;

(b) receive from a player an indication of a plurality of the symbols forming a player symbol set;

(c) for each of the plurality of different characteristics, associate a predicted quantity of symbols with said characteristic, wherein, for at least one of the plurality of different characteristics, the predicted quantity of symbols associated with said at least one characteristic is based on an indication received from the player;

(d) randomly determine an actual quantity of symbols for each of the plurality of different characteristics;

(e) for each of the plurality of different characteristics, randomly select a set of symbols from the plurality of different symbols, associate each symbol of said set of symbols with said characteristic, and add each symbol of said set of symbols to a gaming system symbol set, wherein said set of symbols includes a number of symbols equal to the randomly determined actual quantity of symbols for said characteristic;

(f) determine any primary awards based on a comparison of the player symbol set with the gaming system symbol set;

(g) determine any additional awards based on a comparison of the predicted quantity of symbols with the randomly determined actual quantity of symbols for the characteristic associated with the predicted quantity of symbols; and (h) display any determined primary awards and any determined additional awards.

2. The gaming system of claim 1, wherein the plurality of instructions, when executed by the at least one processor, cause the at least one processor to operate with the at least one input device, for each of the plurality of different characteristics, to:

(a) receive from the player an indication of a predicted quantity of symbols; and (b) determine any additional awards associated with said characteristic based on a comparison of the predicted quantity of symbols for said characteristic with the randomly determined actual quantity of symbols for said characteristic.

3. The gaming system of claim 1, wherein the plurality of instructions, when executed by the at least one processor, cause the at least one processor to operate with the at least one input device to:

(a) receive from the player an indication of a second predicted quantity of symbols for a set of a plurality of the characteristics; and (b) determine any additional awards associated with said set of the characteristics based on a comparison of the second predicted quantity of symbols with a sum of the randomly determined actual quantities of symbols for the characteristics of said set.

4. The gaming system of claim 1, wherein the predicted quantity of symbols associated with each characteristic is at least one.

5. The gaming system of claim 1, wherein a sum of the actual quantities of symbols is equal to a designated quantity.

6. The gaming system of claim 5, wherein the designated quantity is equal to a quantity of the symbols included in the gaming system symbol set.

7. A method of operating a gaming system, said method comprising:

for a play of a game:

(a) causing at least one processor to execute a plurality of instructions stored in at least one memory device to operate with at least one display device to display a plurality of different symbols and an indication of each of a plurality of different characteristics;

(b) causing the at least one processor to execute the plurality of instructions to operate with at least one input device to receive from a player an indication of a plurality of the symbols forming a player symbol set;

(c) for each one of the plurality of different characteristics, associate a predicted quantity of symbols with said characteristic, wherein, for at least one of the plurality of different characteristics, the predicted quantity of symbols associated with said at least one characteristic is based on an indication received from the player;

(d) causing the at least one processor to execute the plurality of instructions to randomly determine an actual quantity of symbols for each of the plurality of different characteristics;

(e) causing the at least one processor to execute the plurality of instructions to, for each of the plurality of different characteristics, randomly select a set of symbols from the plurality of different symbols, associate each symbol of said set of symbols with said characteristic, and add each symbol of said set of symbols to a gaming system symbol set, wherein said set of symbols includes a number of symbols equal to the randomly determined actual quantity of symbols for said characteristic;

(f) causing the at least one processor to execute the plurality of instructions to determine any primary awards based on a comparison of the player symbol set with the gaming system symbol set;

(g) causing the at least one processor to execute the plurality of instructions to determine any additional awards based on a comparison of the predicted quantity of symbols with the randomly determined actual quantity of symbols for the characteristic associated with the predicted quantity of symbols; and (h) causing the at least one processor to execute the plurality of instructions to operate with the at least one display device to display any determined primary awards and any determined additional awards.

8. The method of claim 7, which includes causing the at least one processor to execute the plurality of instructions to operate with the at least one input device, for each of the plurality of different characteristics, to:

(a) receive from the player an indication of a predicted quantity of symbols; and (b) determine any additional awards associated with said characteristic based on a comparison of the predicted quantity of symbols for said characteristic with the randomly determined actual quantity of symbols for said characteristic.

9. The method of claim 7, which includes causing the at least one processor to execute the plurality of instructions to operate with the at least one input device to:

(a) receive from the player an indication of a second predicted quantity of symbols for a set of a plurality of the characteristics; and (b) determine any additional awards associated with said set of the characteristics based on a comparison of the second predicted quantity of symbols with a sum of the randomly determined actual quantities of symbols for the characteristics of said set.

10. The method of claim 7, wherein the predicted quantity of symbols associated with each characteristic is at least one.

11. The method of claim 7, wherein a sum of the actual quantities of symbols is equal to a designated quantity.

12. The method of claim 11, wherein the designated quantity is equal to a quantity of the symbols included in the gaming system symbol set.

13. The method of claim 7, which is provided through a data network.

14. The method of claim 13, wherein the data network is an internet.

15. A non-transitory computer readable medium storing a plurality of instructions which, when executed by at least one processor, cause the at least one processor to:

for a play of a game:

(a) cause at least one display device to display a plurality of different symbols and an indication of each of a plurality of different characteristics;

(b) operate with at least one input device to receive from a player an indication of a plurality of the symbols forming a player symbol set;

(c) for each of a plurality of different characteristics, associate a predicted quantity of symbols with said characteristic, wherein, for at least one of the plurality of different characteristics, the predicted quantity of symbols associated with said at least one characteristic is based on an indication received from the player;

(d) randomly determine an actual quantity of symbols for each of the plurality of different characteristics;

(e) for each of the plurality of different characteristics, randomly select a set of symbols from the plurality of different symbols, associate each symbol of said set with said characteristic, and add each symbol of said set to a gaming system symbol set, wherein said set of symbols includes a number of symbols equal to the randomly determined actual quantity of symbols for said characteristic;

(f) determine any primary awards based on a comparison of the player symbol set with the gaming system symbol set;

(g) determine any additional awards based on a comparison of the predicted quantity of symbols with the randomly determined actual quantity of symbols for the characteristic associated with the predicted quantity of symbols; and (h) cause the at least one display device to display any determined primary awards and any determined additional awards.

16. The non-transitory computer readable medium of claim 15, wherein the plurality of instructions, when executed by the at least one processor, cause the at least one processor to operate with the at least one input device, for each of the plurality of different characteristics, to:

(a) receive from the player an indication of a predicted quantity of symbols; and (b) determine any additional awards associated with said characteristic based on a comparison of the predicted quantity of symbols for said characteristic with the randomly determined actual quantity of symbols for said characteristic.

17. The non-transitory computer readable medium of claim 15, wherein the plurality of instructions, when executed by the at least one processor, cause the at least one processor to operate with the at least one input device to:

(a) receive from the player an indication of a second predicted quantity of symbols for a set of a plurality of the characteristics; and (b) determine any additional awards associated with said set of the characteristics based on a comparison of the second predicted quantity of symbols with a sum of the randomly determined actual quantities of symbols for the characteristics of said set.

18. The non-transitory computer readable medium of claim 15, wherein the predicted quantity of symbols associated with each characteristic is at least one.

19. The non-transitory computer readable medium of claim 15, wherein a sum of the actual quantities of symbols is equal to a designated quantity.

20. The non-transitory computer readable medium of claim 19, wherein the designated quantity is equal to a quantity of the symbols included in the gaming system symbol set.

* * * * *